US009116464B2

(12) United States Patent
Komatsu et al.

(10) Patent No.: US 9,116,464 B2
(45) Date of Patent: Aug. 25, 2015

(54) DEVELOPING DEVICE AND IMAGE FORMING APPARATUS

(71) Applicants: Makoto Komatsu, Kanagawa (JP); Kaoru Kataoka, Kanagawa (JP); Mikio Kamoshita, Tokyo (JP); Masaru Kumagai, Kanagawa (JP); Atsushi Mori, Kanagawa (JP)

(72) Inventors: Makoto Komatsu, Kanagawa (JP); Kaoru Kataoka, Kanagawa (JP); Mikio Kamoshita, Tokyo (JP); Masaru Kumagai, Kanagawa (JP); Atsushi Mori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 43 days.

(21) Appl. No.: 13/756,705

(22) Filed: Feb. 1, 2013

(65) Prior Publication Data

US 2013/0202319 A1 Aug. 8, 2013

(30) Foreign Application Priority Data

Feb. 7, 2012 (JP) ..... 2012-023705

(51) Int. Cl.
*G03G 15/08* (2006.01)

(52) U.S. Cl.
CPC ..... *G03G 15/0824* (2013.01); *G03G 15/0849* (2013.01); *G03G 15/0879* (2013.01); *G03G 15/0893* (2013.01)

(58) Field of Classification Search
CPC ..... G03G 15/0849–15/0855
USPC ..... 396/62
See application file for complete search history.

(56) References Cited

U.S. PATENT DOCUMENTS

| | | | | |
|---|---|---|---|---|
| 4,908,666 | A * | 3/1990 | Resch, III | 399/61 |
| 4,963,454 | A * | 10/1990 | Yano et al. | 430/111.32 |
| 6,404,997 | B1 * | 6/2002 | Grace | 399/27 |
| 6,949,896 | B2 | 9/2005 | Andoh et al. | |
| 7,450,867 | B2 | 11/2008 | Itoyama et al. | |
| 7,576,509 | B2 | 8/2009 | Komatsu et al. | |
| 7,761,015 | B2 * | 7/2010 | Wong | 399/27 |
| 7,853,189 | B2 | 12/2010 | Kamoshita et al. | |
| 7,925,188 | B2 * | 4/2011 | Senoh et al. | 399/255 |
| 8,145,078 | B2 * | 3/2012 | Mestha et al. | 399/30 |
| 8,238,768 | B2 | 8/2012 | Koizumi et al. | |
| 2007/0053704 | A1 * | 3/2007 | Hisatomi | 399/27 |
| 2012/0027434 | A1 | 2/2012 | Koizumi et al. | |
| 2012/0051760 | A1 | 3/2012 | Komatsu | |

FOREIGN PATENT DOCUMENTS

| | | |
|---|---|---|
| JP | 2006-171023 | 6/2006 |
| JP | 2010-091785 | 4/2010 |

* cited by examiner

*Primary Examiner* — Clayton E Laballe
*Assistant Examiner* — Leon W Rhodes, Jr.
(74) *Attorney, Agent, or Firm* — Oblon, McClelland, Maier & Neustadt, L.L.P.

(57) ABSTRACT

An image forming apparatus includes a latent image carrier carrying a latent image, a developing device visualizing the latent image utilizing a two-component developer, a supply device supplying toner according to a change in toner density in the two-component developer inside the developing device, and a control device having an input side connected to a density sensor detecting a value of the toner density and an image information acquisition device acquiring information on an image formed on the latent image carrier, and an output side connected to a driving device driving the supply device. When the detected value is higher than a target value of the toner density stored by the control device, the control device performs control to stop the driving device or drive the driving device to supply toner in an amount less than a combined toner supply amount of first and second toner supply amounts.

15 Claims, 20 Drawing Sheets

RELATED ART

DEVELOPING DEVICE AND IMAGE FORMING APPARATUS

BACKGROUND OF THE INVENTION

1. Field of the Invention

The disclosures discussed herein relate to a developing device and an image forming apparatus, and more specifically relate to toner supply control for use in binary developer (i.e., two-component developer).

2. Description of the Related Art

In an image forming apparatus such as a copier, a printer, and a facsimile machine, a developing device generally conducts a process for visualizing an electrostatic latent image formed on a photoreceptor serving as a latent image carrier, and a visualized image is transferred onto a sheet or the like, thereby outputting a recording result.

As a developer used for the developing process, there is a two-component system (or a binary system) developer formed of a mixture of a toner and a carrier, other than a one-component system developer formed of either magnetic or nonmagnetic toner alone. The binary developer may be configured to be ready to be electrostatically attracted to the electrostatic latent image on the photoreceptor by charging the toner with a frictional electrification action generated at the time of stirring the mixture.

When the developing process is conducted, it may be necessary to optimize the amount of toner attracted to the electrostatic latent image on the photoreceptor for improving image quality. In order to optimize the amount of toner attracted to the electrostatic latent image, it may be necessary to manage density of toner contained in the two-component system developer. Specifically, it may be important to match a value (i.e., a detected value or a current value) of toner density and a target value of the toner density. In order to match the detected value of the toner density in the two-component system developer and the target value of the toner density inside the developing device, additional toner is supplied to the two-component system developer when the toner density is lowered. However, it may be difficult to accurately detect the amount of toner actually supplied to the two-component system developer corresponding to a set toner supply amount because the toner is formed of powder. Specifically, when there is environmental fluctuation such as temperature fluctuation, humidity fluctuation, or a setting changed by a user, the toner supply amount may need to be adjusted according to such fluctuation or the like.

In the related-art technologies, a toner supply control method is widely used. In the toner supply control method, a value of toner density is detected by a sensor, and the amount of toner to be supplied is controlled based on the detected result (i.e., the detected value). In this case, the toner density may be adjusted not only by increasing the toner density but also by decreasing the toner density. It may be possible to control the supply of toner to improve the toner density when the toner density is lowered in a design phase; however, it may be difficult to control consumption of toner in the design phase, which is often left under the usage conditions of the user.

For example, when a target value of the toner density may need to be changed toward a low toner density due to change in an optimal condition, the toner that is continuously consumed until the toner density reaches the set low toner density (i.e., the target value of the toner density) is not assumed in the design phase. Accordingly, the user may need to wait until the detected value of the toner density is lowered for the continuation of executing image formation. Accordingly, in the related toner supply control that specifically focuses on compensating the toner density reduction, it may be difficult to change the toner supply amount to the optimal toner density including changing the toner supply amount to the low toner density. Specifically, when the (setting of) toner density is changed to the low toner density, the user may need to wait until the toner is continuously consumed by forming images such that the toner density becomes low. This may result in an unstable image quality. Hence, images may be formed with undesired density, or the quality of the formed images may deteriorate.

As an example of a configuration to implement the above toner supply control method, Japanese Laid-open Patent Publication No. 2010-091785 (hereinafter referred to as "Patent Document 1") discloses a configuration including a sensor to detect density of an image, where excess or deficiency of toner contained in developer is determined according to a change in the image density, and a toner supply amount is controlled based on the determined result. Further, in order to prevent delay in supplying toner or excessive toner supply when the toner is supplied, Japanese Laid-open Patent Publication No. 2006-171023 (hereinafter called "Patent Document 2") discloses an example of a configuration in which a toner supply amount is computed by multiplying a toner supply rate computed based on image density by a predetermined coefficient.

RELATED ART DOCUMENTS

Patent Document

Patent Document 1: Japanese Laid-open Patent Publication No. 2010-091785

Patent Document 2: Japanese Laid-open Patent Publication No. 2006-171023

In the above configurations, the reduction of toner density is expected; that is, only supplying toner to increase the toner density is expected, and decreasing the toner to low toner density is not expected. Thus, as mentioned earlier, when the (setting of) toner density is changed toward the low toner density, the user may need to wait until the toner is continuously consumed by forming images such that the toner density becomes low. This may result in unstable image quality. Hence, an image may be formed with undesired density, or the quality of formed images may deteriorate.

SUMMARY OF THE INVENTION

Accordingly, it is an object of the invention to provide a developing device capable of correcting toner density either to a high density level or to a low density level within a supply control condition set in a design phase, other than toner supply control set in the design phase for the purpose of preventing density of toner from lowering, and an image forming apparatus having such a developing device, which may substantially eliminate one or more problems caused by the limitations and disadvantages of the related art.

According to one embodiment, there is provided an image forming apparatus that includes an electrostatic latent image carrier configured to carry an electrostatic latent image; a developing device configured to visualize the electrostatic latent image utilizing a two-component developer; a supply device configured to supply toner according to a change in toner density of toner contained in the two-component developer inside the developing device; and a control device having an input side connected to a density sensor configured to detect a value of the toner density and an image information acquisition device configured to acquire information on an image formed on the electrostatic latent image carrier, and an output side connected to a driving device configured to drive the supply device. In the image forming apparatus, the control device is configured to store a target value of the toner density, and the control device includes a feedforward control unit configured to determine a first toner supply amount matching the target value based on an input from the image information acquisition device; and a feedback control unit configured to determine a second toner supply amount based on a difference between the detected value of the toner density obtained by the density sensor and the target value. When the control device obtains a comparison result indicating that the detected value is higher than the target value, the control device performs control to stop the driving device, or performs control to drive the driving device to supply toner in an amount less than a combined toner supply amount obtained by adding the first toner supply amount and the second toner supply amount.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
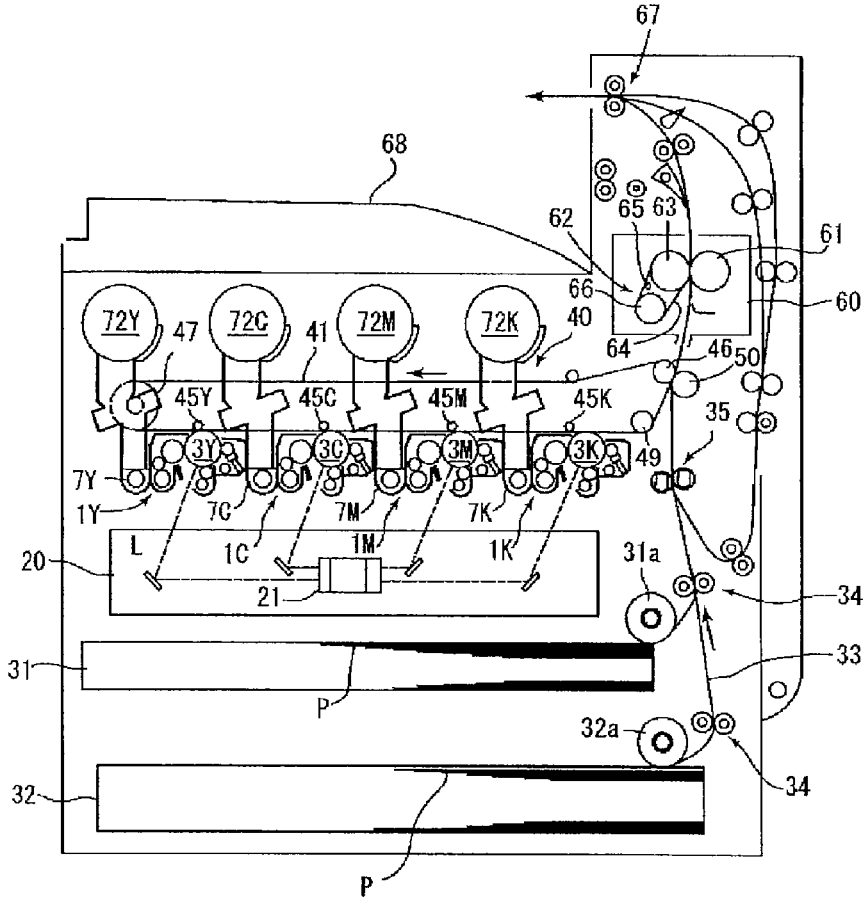
FIG. 1 is a schematic diagram illustrating an example of an image forming apparatus to which a developing device according to an embodiment is applied.

Preferred embodiments are described below, with reference to the accompanying drawings. FIG. 1 illustrates a full-color printer serving as one of the examples of the image forming apparatus. The full-color printer includes four image forming units 1Y, 1C, 1M and 1K corresponding to yellow (Y), cyan (C), magenta (M), and black (B) disposed along a tension surface of an intermediate transfer belt 41 serving as an intermediate transfer member. The four image forming units 1Y, 1C, 1M and 1K have the same configuration except for utilizing toner of mutually different colors Y, C, M, and K serving as image forming materials to form an image.

Figure 2:
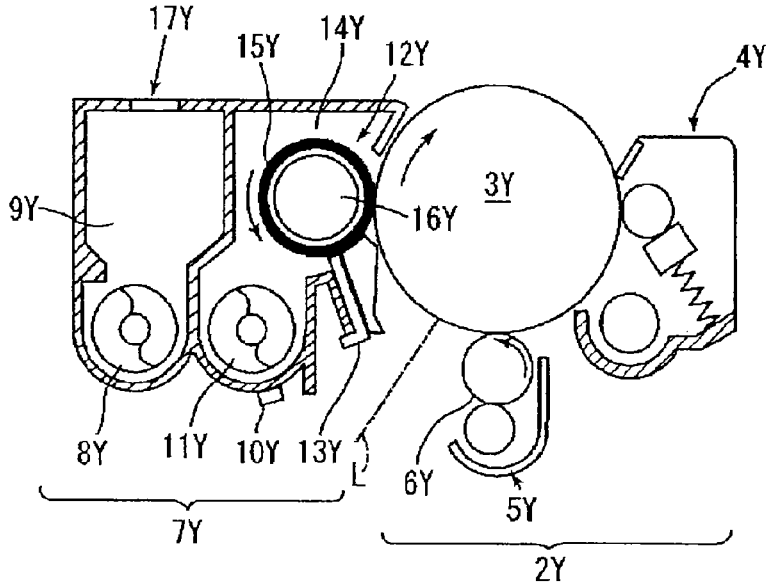
FIG. 2 is a diagram illustrating a configuration of an image forming unit including the developing device applied to the image forming apparatus illustrated in FIG. 1.
Figure 3:
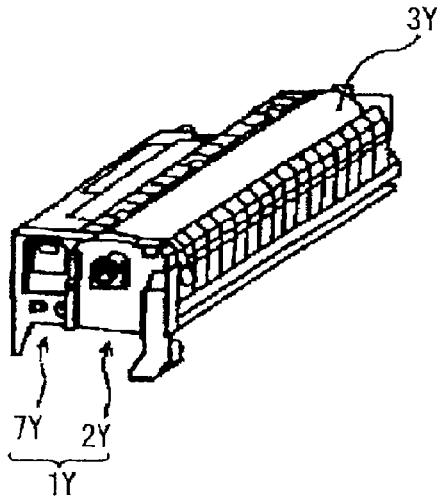
FIG. 3 is a perspective diagram illustrating the image forming unit illustrated in FIG. 2.

In the following, a configuration of the image forming unit is described. FIG. 2 is a diagram illustrating a configuration of the image forming unit 1Y configured to form a Y-toner image. FIG. 3 is a perspective diagram illustrating an appearance of the image forming unit 1Y. In FIGS. 2 and 3, the image forming unit 1Y includes a photoreceptor unit 2Y and a development unit 7Y. The photoreceptor unit 2Y and the development unit 7Y are integrally configured as the image forming unit 1Y, which is removably attached to a printer main body as illustrated in FIG. 3. Note that when the image forming unit 1Y integrally formed of the photoreceptor unit 2Y and the development unit 7Y is removed from the printer main body, the development unit 7Y may be attached to or removed from the not-illustrated photoreceptor unit.

The photoreceptor unit 2Y includes a drum-shaped photoreceptor 3Y serving as a latent image carrier, and a drum cleaning device 4Y, a not-illustrated static eliminator, a charging device 5Y, and the like. The charging device 5Y serving as a charging unit is configured to uniformly charge, utilizing a charging roller 6Y, a surface of the photoreceptor 3Y rotationally driven by a not-illustrated drive unit in FIG. 2 in a clockwise direction.

Specifically, in FIG. 2, a charging bias is applied to the charging roller 6Y rotationally driven in a counterclockwise direction from a not-illustrated power source, and the photoreceptor 3Y is charged by causing the charging roller 6Y to come into contact with or closer to the photoreceptor 3Y. Note that other charging members such as a charging brush or the like configured to come into contact with or come close to the photoreceptor 3Y may be used instead of the charging roller 6Y. Further, a charging member such as a scorotron charger configured to uniformly charge the photoreceptor 3Y by a charger system may be used in place of the charging roller 6Y. Details of the cleaning device 4Y illustrated in FIG. 2 are not described; however, the cleaning device 4Y is configured to supply a lubricant to the surface of the photoreceptor 3Y after having removed the residual toner remaining on the surface of the photoreceptor 3Y.

The surface of the photoreceptor 3Y uniformly charged by the charging device 5Y is scanned and exposed with laser light L emitted from an optical writing unit 20 serving as the later-described latent image forming unit such that the surface of the photoreceptor 3Y carries a yellow (Y) electrostatic latent image.

Figure 4:
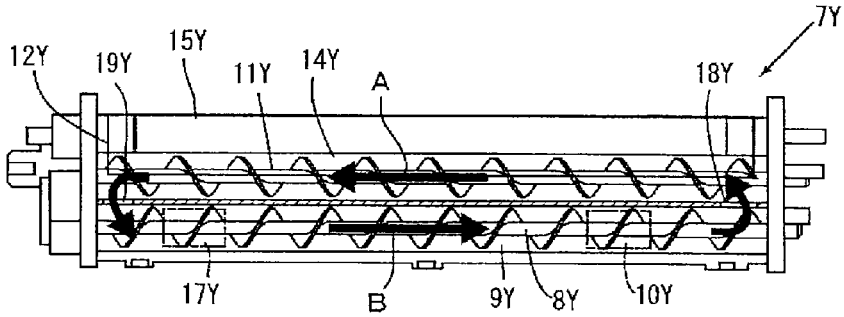
FIG. 4 is a diagram illustrating a main configuration of the developing device provided in the image forming unit illustrated in FIG. 2.

The configuration of the developing device 7Y is illustrated in FIG. 4. In FIG. 4, the developing device 7Y serving as a development unit includes a first agent container 9Y having a first transfer screw 8Y serving as a developer transfer unit as illustrated in FIGS. 2 and 4. The developing device 7Y further includes a second agent container 14Y having a toner density sensor 10Y, a second transfer screw 11Y serving as a developer transfer unit, a development roll 12Y serving as a developer carrier, and a doctor blade 13Y serving as a developer regulating member.

These two agent containers forming circulatory pathways contain not-illustrated Y-developer that is a binary developer (two-component system developer). The Y-developer is composed of a magnetic carrier and Y-toner exhibiting a negative electrostatic property. The first transfer screw 8Y rotationally driven by a not-illustrated driving unit transfers the Y-developer contained in the first agent container 9Y toward a front side of the image forming unit in FIG. 2, that is, in a direction indicated by an arrow A in FIG. 4.

The toner density of the transferred Y-developer is detected by the toner density sensor 10Y fixed on an upper part of the first transfer screw 8Y while passing through a predetermined detecting part located downstream in the developer circulatory direction from a part (hereinafter called a "supply position") facing a toner supply port 17Y in the first agent container 9Y. The Y-developer transferred by the first transfer screw 8Y to an end part of the first agent container 9Y passes through a communicating port 18Y, and then enters the second agent container 14Y.

The second transfer screw 11Y rotationally driven by a not-illustrated driving unit transfers the Y-developer contained in the second agent container 14Y toward a rear side of the image forming unit in FIG. 2, that is, in a direction indicated by an arrow B in FIG. 4. As illustrated in FIG. 2, the development roll 12Y is disposed above and in parallel with the second transfer screw 11Y that transfers the Y-developer in the above fashion.

In FIG. 2, the development roll 12Y is configured to include a development sleeve 15Y having a magnet roller 16Y at a fixed position inside the development sleeve 15Y. The development sleeve 15Y is formed of a non-magnetic sleeve rotationally driven in a counter-clock direction. A part of the Y-developer transferred by the second transfer screw 11Y is scooped and placed onto a surface of the development sleeve 15 by magnetic force generated by a magnetic roller 16Y. The thickness of the Y-developer on the surface of the development sleeve 15 is regulated by the doctor blade 13Y disposed at a position having a predetermined gap from the surface of the development sleeve 15Y. Having regulated the thickness of the Y-developer on the surface of the development sleeve 15Y, the Y-developer is transferred to a position facing the photoreceptor 3Y to allow the Y-toner to be attached to a Y-electrostatic latent image on the photoreceptor 3Y.

Hence, a Y-toner image is formed on the photoreceptor 3Y by attaching the Y-toner on the electrostatic latent image on the photoreceptor 3Y. The Y-developer having a reduced Y-toner due to the development is returned to the second transfer screw 11Y along with the rotation of the development sleeve 15Y. The Y-developer transferred by the second transfer screw 11Y to an end part of the second agent container 14Y passes through a communicating port 19Y, and then returns to the first agent container 9Y. The Y-developer is circulated inside the development unit in the above fashion.

In FIG. 1, the Y-toner image formed on the photoreceptor 3Y is intermediately transferred onto the intermediate transfer belt 41 serving as an intermediate member. The drum cleaning device 4Y of the photoreceptor unit 2Y eliminates residual toner remaining on the surface of the photoreceptor 3Y after having the Y-toner image on the photoreceptor 3Y transferred onto the intermediate transfer belt 41. A not-illustrated static eliminator eliminates static electricity from the surface of the photoreceptor drum 3Y that has been cleaned by the drum cleaning device 4Y. The surface of the photoreceptor drum 3Y is initialized by the above static elimination to be ready for a next image formation. Similarly, the C-toner image, M-toner image, and K-toner image are formed on the respective photoreceptors 3C, 3M, and 3K, and are intermediately transferred onto the intermediate transfer belt 41 in image forming units 1C, 1M, and 1K of other colors.

In FIG. 1, the optical writing unit 20 is disposed beneath the image forming units 1Y, 1C, 1M, and 1K. The optical writing unit 20 is configured to apply laser light L onto the photoreceptors 3Y, 3C, 3M, and 3K of the respective image forming units 1Y, 1C, 1M, and 1K. Thus, respective Y, C, M, and K electrostatic latent images are formed on the photoreceptors 3Y, 3C, 3M, and 3K. Note that the optical writing unit 20 is configured to apply laser light L onto the photoreceptors 3Y, 3C, 3M, and 3K via plural optical lenses and mirrors while deflecting the laser light L (see FIG. 1) emitted from a light source by a polygon mirror 21 rotationally driven by a not-illustrated motor. Note that alternatively, the optical scanning may be carried out by a configuration employing a light emitting diode (LED) array instead of the above-described configuration.

A first sheet-feeding cassette 31 and a second sheet-feeding cassette 32 are disposed such that the sheet-feeding cassettes 31 and 32 are stacked in a vertical direction. Each of the sheet-feeding cassettes 31 and 32 contains a bundle of stacked recording sheets P serving as recording materials, and a first sheet-feeding roller 31*a* and a second sheet-feeding roller 32*a* are brought into contact with a top recording sheet P of the respective bundles.

When the first sheet-feeding roller 31*a* is rotationally driven by a not-illustrated driving unit in a counterclockwise direction in FIG. 1, the top recording sheet P of the bundle in the first sheet-feeding cassette 31 is discharged toward a sheet-feeding path 33 extendedly disposed in a vertical direction on the right-hand side of the first sheet-feeding cassette 31 in FIG. 1. Further, when the second sheet-feeding roller 32*a* is rotationally driven by a not-illustrated driving unit in a counterclockwise direction in FIG. 1, the top recording sheet P of the bundle in the second sheet-feeding cassette 32 is discharged toward the sheet-feeding path 33.

Since the sheet-feeding path 33 includes plural transfer roller pairs 34, the recording sheet P fed to the sheet-feeding path 33 is transferred from a lower side to an upper side in FIG. 1 while being sandwiched between rollers of each of the transfer roller pairs 34. Further, a resist roller pair 35 is disposed at an end of the sheet-feeding path 33. The resist roller pair 35 temporarily stops the roller rotations immediately after the recording sheet P transferred from the transfer roller pair 34 is sandwiched between the rollers of the resist roller pair 35. The resist roller pair 35 then transfers the recording sheet P to a secondary transfer nip at an appropriate timing.

In FIG. 1, an image-transfer unit 40 is disposed above the image forming units 1Y, 1C, 1M, and 1K in FIG. 1, and configured to cause the intermediate transfer belt 41 to endlessly travel in a counterclockwise direction in FIG. 1 in a tensioned fashion. The image-transfer unit 40 includes a belt cleaning unit (not illustrated) 42, a first bracket (not illustrated) 43, and a second bracket (not illustrated) 44, other than the intermediate transfer belt 41. The image-transfer unit 40 further includes four primary transfer rollers 45Y, 45C, 45M, 45K, a secondary backup roller 46, a driving roller 47, an auxiliary roller (not illustrated) 48, and a tension roller 49.

The intermediate transfer belt 41 is endlessly moved by rotational driving of the driving roller 47 in a counterclockwise direction while being looped over the above rollers in a tensioned fashion. The endlessly moving intermediate transfer belt 41 is sandwiched between the four primary transfer rollers 45Y, 45C, 45M, and 45K and the photoreceptors 3Y, 3C, 3M, and 3K, thereby forming respective primary transfer nips. Then, a transfer bias having reversed polarity of toner (positive polarity in this embodiment) is applied to an inner circumferential surface of the intermediate transfer belt 41. The toner images of respective colors on the photoreceptors 3Y, 3C, 3M, and 3K are superimposed one another on an outer circumferential surface of the intermediate transfer belt 41 while the endlessly moving intermediate transfer belt 41 passes through the Y, C, M, and K primary transfer nips. Thus, a superimposed four-color toner image (hereinafter called a "four-color toner image") is formed on the intermediate transfer belt 41.

The intermediate transfer belt 41 is sandwiched between the secondary backup roller 46 and a secondary transfer roller 50 disposed outside the loop, thereby forming a secondary transfer nip. The above-described resist roller pair 35 transfers the recording sheet P sandwiched between the rollers of the resist roller pair 35 toward the secondary transfer nip at a synchronizing timing with the four-color toner image on the intermediate transfer belt 41.

The four-color toner image on the intermediate transfer belt 41 is secondary transferred onto the recording sheet P simultaneously within the secondary nip due to effects of a secondary transfer electric field formed between a secondary transfer roller 50 to which the secondary transfer bias is applied and the secondary transfer backup roller 46 and nip pressure. The four-color toner image, in combination with white color of the recording sheet P, forms a full-color toner image on the recording sheet P.

Residual transfer toner that has not been transferred onto the recording sheet P after having passed through the secondary image transfer nip remains attached on the intermediate transfer belt 41. The residual transfer toner remaining on the intermediate transfer belt 41 is cleaned by the belt cleaning unit 42. Note that in the belt cleaning unit 42, a cleaning blade is brought into contact with a surface of the intermediate transfer belt 41 so as to eliminate the residual transfer toner remaining on the surface of the intermediate transfer belt 41 by scraping the residual transfer toner.

Note that the first bracket 43 of the image-transfer unit 40 is oscillated at a predetermined rotational angle around an axis of rotation of the auxiliary roller 48 by switching ON or OFF to drive a not-illustrated solenoid.

In a printer according to this embodiment, the first bracket 43 is slightly rotated by the above-described solenoid in a counterclockwise direction in the figure to form a monochrome image. The primary transfer rollers 45Y, 45C, 45M are revolved around the axis of rotation of the auxiliary roller 48 in a counterclockwise direction by the rotation of the first bracket 43 to separate the intermediate transfer belt 41 from the Y, C, and M photoreceptors. In FIG. 1, a monochrome image is formed by driving the image forming unit 1K, which is one of the image forming units 1Y, 1C, 1M, and 1K. By driving only the image forming unit 1K, deterioration of the image forming units 1Y, 1C, 1M due to needless driving of the image forming units 1Y, 1C, 1M may be prevented.

In FIG. 1, a fixation unit 60 is disposed above the secondary transfer nip. The fixation unit 60 includes a pressure-heating roller 61 incorporating a heating source such as a halogen lamp, and a fixation belt unit 62.

The fixation belt unit 62 includes a fixation belt 64, a heating roller 63 incorporating a heating source such as a halogen lamp, a tension roller 65, a driving roller 66, and a not-illustrated temperature sensor. The endless fixation belt 64 endlessly travels in a counterclockwise direction in FIG. 1 while being looped over the pressure roller 63, the tension roller 65, and the driving roller 66 in a tensioned fashion. The fixation belt 64 is heated by the heating roller 63 from a rear surface of the fixation belt 64 during an endless traveling process. The pressure-heating roller 61 rotationally driven in a clockwise direction is brought into contact with a part of the surface of the thus heated fixation belt 64 looped over the heating roller 63. Thus, a fixation nip is formed by bringing the pressure-heating roller 61 into contact with the fixation belt 64.

A not-illustrated temperature sensor is disposed outside the loop of the fixation belt 64 such that the temperature sensor faces the surface of the fixation belt 64 via a predetermined gap. The temperature sensor is configured to detect a surface temperature of the fixation belt 64 immediately before its entering the fixation nip. The detected result is transmitted to a not-illustrated fixation power supply circuit. The fixation power supply circuit is configured to switch on or off supplying power to the heating source contained in the heating roller 63 or the heating source contained in the pressure-heating roller 61 based on the detected result by the temperature sensor. As a result, a surface temperature of the fixation belt 64 is maintained approximately at 140° C.

The recording sheet P passing through the secondary transfer nip is transferred into the fixation unit 60 after having been separated from the intermediate transfer belt 41. The full-color toner image is fixed on the recording sheet P by being heated and pressed by the fixation belt 64 in a process of transferring the recording sheet P sandwiched in the fixation nip inside the fixation unit 60 from a lower side to an upper side of FIG. 1.

The recording sheet P to which a fixation process is applied is transferred between rollers of a sheet-discharging roller pair 67, and is then discharged outside the printer. A stack part 68 is disposed on an upper surface of an enclosure of the printer main body such that the recording sheets P discharged outside the printer from the sheet-discharging roller pair 67 are sequentially stacked on the stack part 68.

In FIG. 1, toner bottles 72Y, 72C, 72M, and 72K serving as four toner containers respectively containing Y-toner, C-toner, M-toner, and K-toner are disposed above the image-transfer unit 40. The different colors of toner inside the toner bottles 72Y, 72C, 72M, and 72K are appropriately supplied by a toner supply device 70 to the development units 7Y, 7C, 7M, and 7K of the image forming units 1Y, 1C, 1M, and 1K. The toner bottles 72Y, 72C, 72M, and 72K that are independent from the respective image forming units 1Y, 1C, 1M, and 1K are removably attached to the printer main body.

As illustrated in FIG. 4, the toner density sensor 10Y is configured to detect the density of the toner of the developer in the first agent container 9Y serving as a non-supply area immediately before the developer enters the second agent container 14Y serving as a supply area. Further, the toner supply port 17Y is disposed at a position where toner is supplied corresponding to the developer immediately after the developer has been inserted into the first agent container 9Y from the second agent container 14Y. That is, in the first agent container 9Y, the toner density sensor 10Y serving as a toner density detector is configured to detect the toner density of the developer at a position downstream of the toner supply port 17Y.

Figure 5:
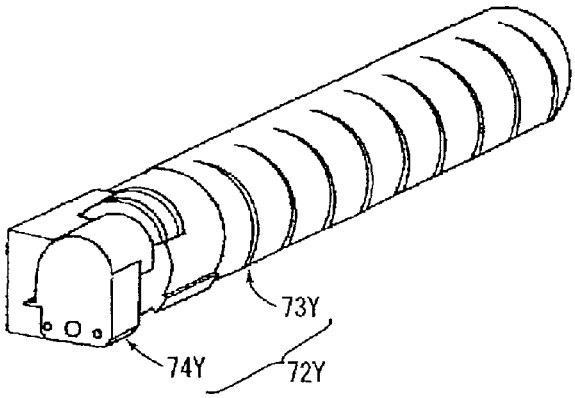
FIG. 5 is a perspective diagram illustrating a configuration of a toner bottle for supplying toner to the developing device illustrated in FIG. 4.

FIG. 5 is a perspective diagram illustrating the Y-toner bottle 72Y. In FIG. 5, the Y-toner bottle 72Y includes a bottle part 73Y serving as a bottle-shaped powder container containing not-illustrated Y-toner as powder, and a cylindrical holder part 74Y serving as a powder discharging part.

Figure 6:
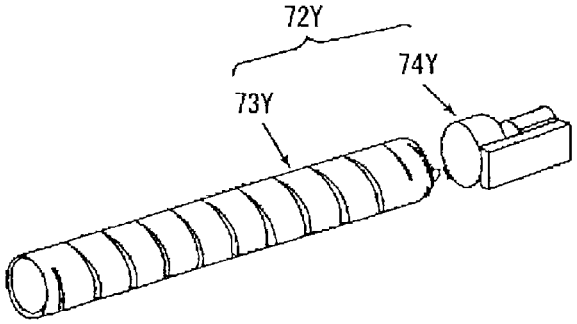
FIG. 6 is an exploded perspective diagram illustrating the toner bottle illustrated in FIG. 5.

The holder part 74Y is engaged with a head part of the bottle part 73Y such that the bottle part 73Y is rotationally retained by the holder part 74Y as illustrated in FIG. 6. a screw-shaped helical projection, which is projected from outside to inside of the container, is formed on an inner circumferential surface of the bottle part 73Y such that the screw-shaped threaded projection extends in a bottle axis direction.

Figure 7:
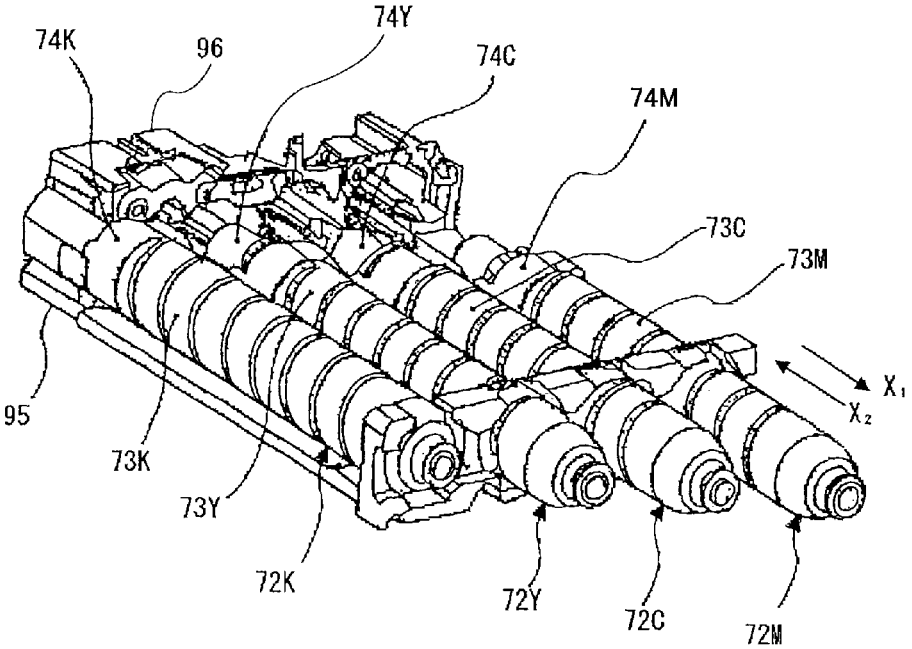
FIG. 7 is a perspective diagram illustrating a configuration of a supply part having plural toner bottles one of which is illustrated in FIG. 5.

FIG. 7 is a perspective diagram illustrating a toner supply device in the printer according to the embodiment. In FIG. 7, the toner supply device serving as a toner supply unit includes a bottle mounting base 95 on which the four toner bottles 72K, 72Y, 72C, and 72M are mounted, and a bottle driving part 96 configured to rotationally drive each of the bottle parts of the toner bottles 72K, 72Y, 72C, and 72M. The toner bottles 72K, 72Y, 72C, and 72M mounted on the bottle mounting base 95 include respective holder parts that are engaged with the bottle driving part 96.

In FIG. 7, when the toner bottle 72M engaged with the bottle driving part 96 is slidably moved on the bottle mounting base 95 in a direction being away from the bottle driving part 96 as indicated by an arrow X1 in FIG. 7, the holder part 74M of the toner bottle 72M is detached from the bottle driving part 96. Thus, the toner bottle 72M may be detached from the toner supply device.

Further, when the toner bottle 72M is slidably moved on the bottle mounting base 95 in a direction toward the bottle driving part 96 as indicated by an arrow X2 in FIG. 7 in the toner supply device to which the toner bottle 72M is not attached, the holder part 74M of the toner bottle 72M is engaged with the bottle driving part 96. Thus, the toner bottle 72M may be attached to the toner supply device. The toner bottles 72K, 72Y, and 72C of other colors (other than yellow Y) may be attached to and detached from the toner supply device by performing the same operations.

Not-illustrated gear parts are formed in respective outer circumferential surfaces of the heads of the bottle parts 73Y, 73C, 73M, and 73K of the respective toner bottles 72Y, 72C, 72M, and 72K. However, the gear parts formed in the outer circumferential surfaces of the heads of the bottle parts 73Y, 73C, 73M, and 73K are covered with the respective holder parts 74Y, 74C, 74M, and 74K. Note that not-illustrated notches are formed in respective parts of the circumferential surfaces of the holder parts 74Y, 74C, 74M, and 74K, such that parts of the gear parts of the bottle parts 73Y, 73C, 73M, and 73K are exposed from the notches. When the holder parts 74Y, 74C, 74M, and 74K of the toner bottles 72Y, 72C, 72M, and 72K are engaged with the bottle driving part 96, not-illustrated bottle power gears of respective colors Y, C, M, and K disposed in the bottle driving part 96 are engaged with the gear parts of the bottle parts 73Y, 73C, 73M, and 73K via the above-described notches. The bottle power gears of respective colors Y, C, M, and K of the bottle driving part 96 are rotationally driven by a not-illustrated driving system such that the bottle parts 73Y, 73C, 73M, and 73K are rotationally driven on the holder parts 74Y, 74C, 74M, and 74K.

In FIG. 6, when the bottle part 73Y is rotated on the holder part 74Y, Y-toner inside the bottle part 73Y moves along the screw-shaped threaded projection from the bottom side of the bottle to the top side of the bottle. The Y-toner then passes through a not-illustrated bottle opening disposed on a front end of the bottle part 73Y serving as a container containing powder, and subsequently flows into the cylindrical holder part 74Y.

Figure 8:
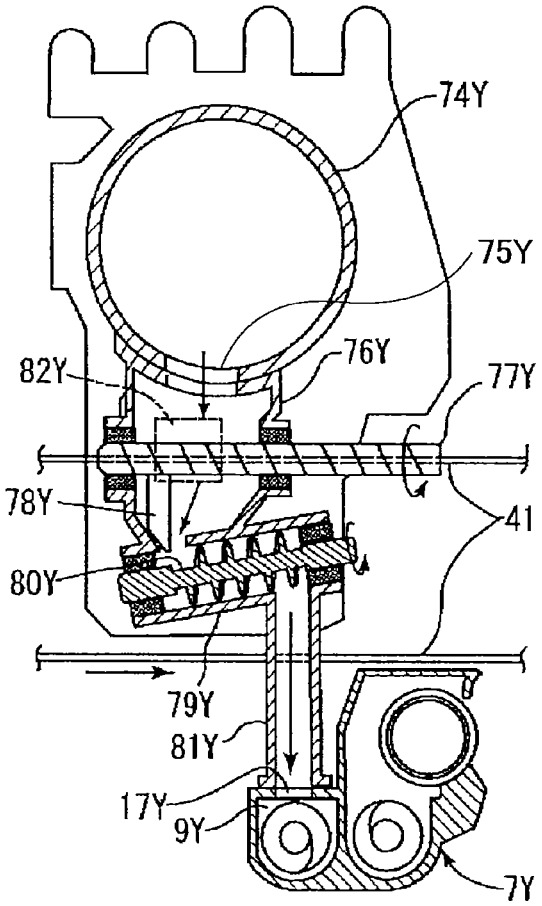
FIG. 8 is a diagram illustrating a structure to supply toner to the developing device illustrated in FIG. 4.

FIG. 8 is a schematic configuration diagram illustrating a toner bottle attached to a not-illustrated toner supply device, and a configuration peripheral to the toner bottle. FIG. 8 illustrates a cross-sectional surface of the toner bottle cut along the holder part 74Y. As described above, the Y-toner inside the bottle part is supplied to the holder part 74Y by rotationally driving the not-illustrated bottle part.

The holder part 74Y of the toner bottle is engaged with a hopper part 76Y of the toner supply device. The hopper part 76Y is formed in a planer shape in a direction perpendicular to the paper surface in the figure and disposed at a position prior to that of the intermediate transfer belt 41. A toner discharge port 75Y formed in a bottom of the holder part 74Y is configured to communicate with a toner receiving port formed in the hopper part 76Y of the toner supply device.

The Y-toner supplied to the bottle part 73Y of the toner bottle 72Y falls in the hopper part 76Y under its own weight. In the hopper part 76Y, a flexible pressing film 78Y fixed to a rotational axis member 77Y rotates along with the rotation of the rotational axis member 77Y. A toner detector 82 composed of a piezoelectric element and configured to detect presence or absence of toner inside the hopper part 76Y is fixed to an inner wall of the hopper part 76Y.

The pressing film 78Y formed of a polyethylene terephthalate (PET) film or the like presses the Y-toner on a detecting surface of the toner detector 82Y along the rotation of the pressing film 78Y. Accordingly, the toner detector 82Y may be able to detect the Y-toner inside the hopper part 76Y in an excellent fashion.

The rotational drive-controlling of the bottle part 73Y of the toner bottle 72Y is performed such that the toner detector 82 may be able to detect Y-toner in an excellent fashion. Accordingly, a sufficient amount of Y-toner falls in the hopper part 76Y via the holder part 74Y from the bottle part 73Y insofar as the bottle part 73Y has a sufficient amount of Y-toner. Hence, the hopper part 76Y is provided with a sufficient amount of Y-toner. When the above status is changed to a status in which Y-toner is not detected by the toner detector 82 despite the fact that the bottle part is frequently rotated, a not-illustrated controller determines that there is little toner remaining in the bottle part, and transmits an alarm indicating a "toner near-end" status to a user.

A lateral transfer tube 79Y is connected to a lower part of the hopper part 76Y, such that the Y-toner inside the hopper part 76Y slides on a taper under its own weight to fall into the lateral transfer tube 79Y. The lateral transfer tube 79Y includes a toner supply screw 80Y, such that the Y-toner is laterally transferred in a longitudinal direction of the lateral transfer tube 79Y with rotation of the toner supply screw 80Y. A fall guide tube 81Y is connected to one end in a longitudinal direction of the lateral transfer tube 79Y such that the fall guide tube 81Y extends in a vertical direction.

A lower end of the fall guide tube 81Y is connected to the toner supply port 17Y of the first agent container 9Y of the development unit 7Y. When the toner supply screw 80Y inside the lateral transfer tube 79Y is rotated, the Y-toner transferred to one end in the longitudinal direction of the lateral transfer tube 79Y falls into the first agent container 9Y of the development unit 7Y via the fall guide tube 81Y and the toner supply port 17Y. Thus, the Y-toner is supplied to the first agent container 9Y. Toner of other colors (C, M, and K) may be supplied to the respective first agent containers in a similar fashion.

Figure 9:
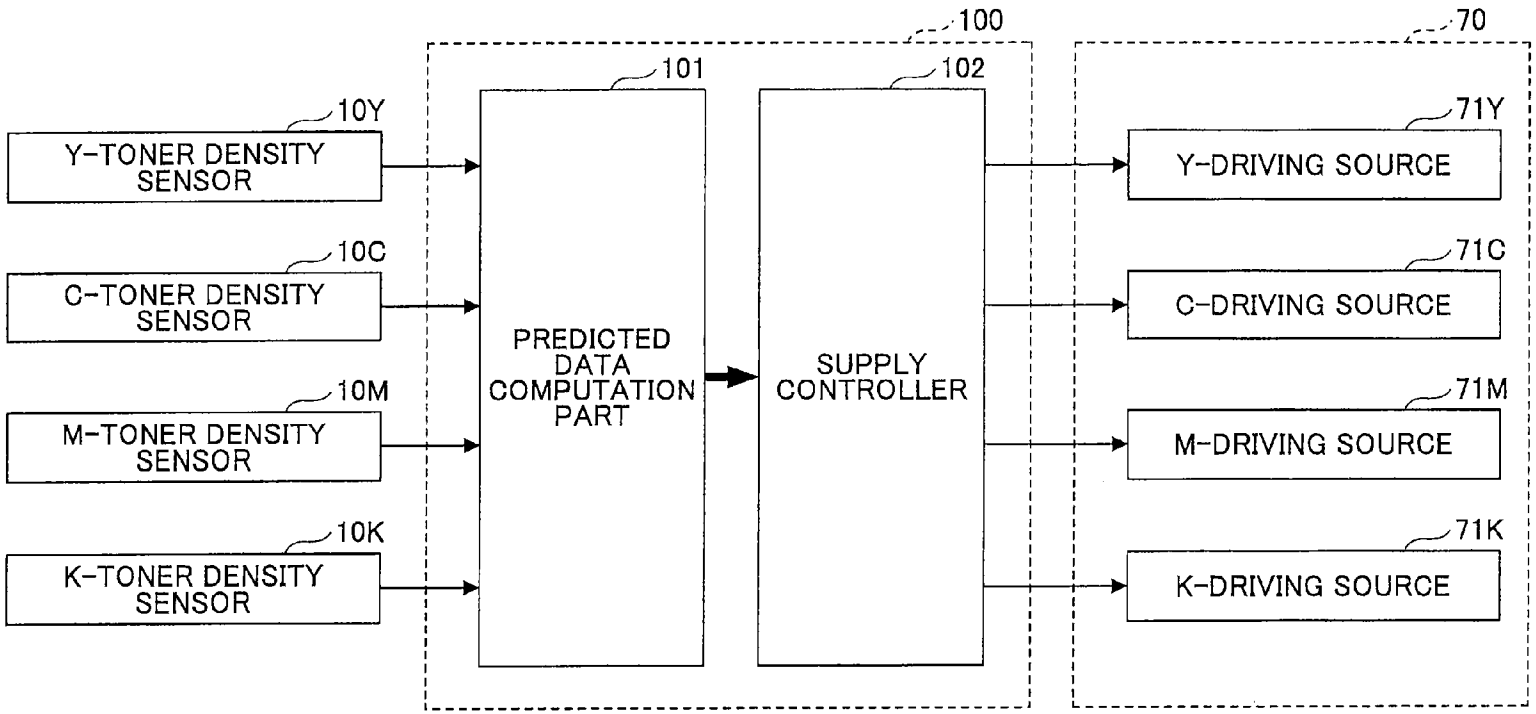
FIG. 9 is a block diagram illustrating a configuration of a controller in the developing device according to the embodiment.

The amount of toner to be supplied is, as illustrated in FIG. 9, adjusted by a supply control part 102 of a controller 100 serving as a supply control unit controlling driving timings, driving durations, driving speeds, and the like of driving sources 71Y to 71K driving toner supply members of a toner supply device. Note that the toner supply members to be used may be any known toner supply members that are capable of supplying toner from the toner supply ports 17Y to 17K developer by driving forces of the driving sources 71Y to 71K.

FIG. 9 is a block diagram illustrating a configuration of the controller 100 performing toner supply control. In FIG. 9, as an example, the detected result of the toner density of the Y-developer obtained by the toner density sensor unit 10Y is transmitted as an electric signal to the later-described controller 100.

The controller 100 is composed of a central processing unit (CPU) serving as a processor, a random access memory (RAM), a read only memory (ROM), and the like serving as a data storage unit, and configured to execute various types of operating processes or control programs.

As a configuration associated with the embodiment, respective toner density sensor units 10Y, 10C, 10M, and 10K are connected to an input side of the controller 100, and respective driving sources 71Y, 71C,71M, and 71K disposed at the toner supply parts are connected to an output side of the controller 100. The RAM disposed in the controller 100 stores data such as a Y-target output voltage Y-Vtref from the toner density sensor unit 10Y, a C-target output voltage C-Vtref from the toner density sensor unit 10C, an M-target output voltage M-Vtref from the toner density sensor unit 10M, and a K-target output voltage K-Vtref from the toner density sensor unit 10K installed in the development units 7Y, 7C, 7M, and 7K, respectively.

In the development unit 7Y, an output voltage value of the toner density sensor unit 10Y and Y-Vtref are compared, and the driving source 71Y of the Y-toner supply device 70 is controlled such that the amount of Y-toner adjusted based on the comparison result is supplied from the toner supply port 17Y. With this control, an appropriate amount of Y-toner is supplied to the first container 9Y corresponding to the Y-developer having decreased Y-toner density due to Y-toner consumed by a developing operation. Accordingly, toner density of the Y-developer inside the second agent container 14Y may be maintained within a target density range of the toner density. Similarly, toner density of each of other developers, that is, the C-developer, the M-developer, and the K-developer inside the respective second agent containers 14C to 14K may also be maintained within a corresponding target density range of the toner density. The toner supply control executed by the developing device according to the embodiment is to eliminate nonuniform toner density. Details of the toner supply control are described later.

In FIG. 9, the supply control part 102 is configured to control the driving source 71Y, which is one of the driving sources held by the toner supply device 70, based on predicted data computed by a predicted data computation part 101 of the controller 100 serving as a predicted data computation unit. In the predicted data computation part 101, predicted data on the toner density of the Y-developer in time variation are computed based on a detected result of the toner density sensor unit 10Y by utilizing an arithmetic program or an arithmetic table stored in the ROM. The supply control part 102 of the controller 100 serving as a supply control unit is configured to eliminate nonuniform toner density by drive-controlling the driving source 71Y by utilizing a combination of later-described unit supply patterns based on the predicted data computed by the predicted data computation part 101.

Figure 10:
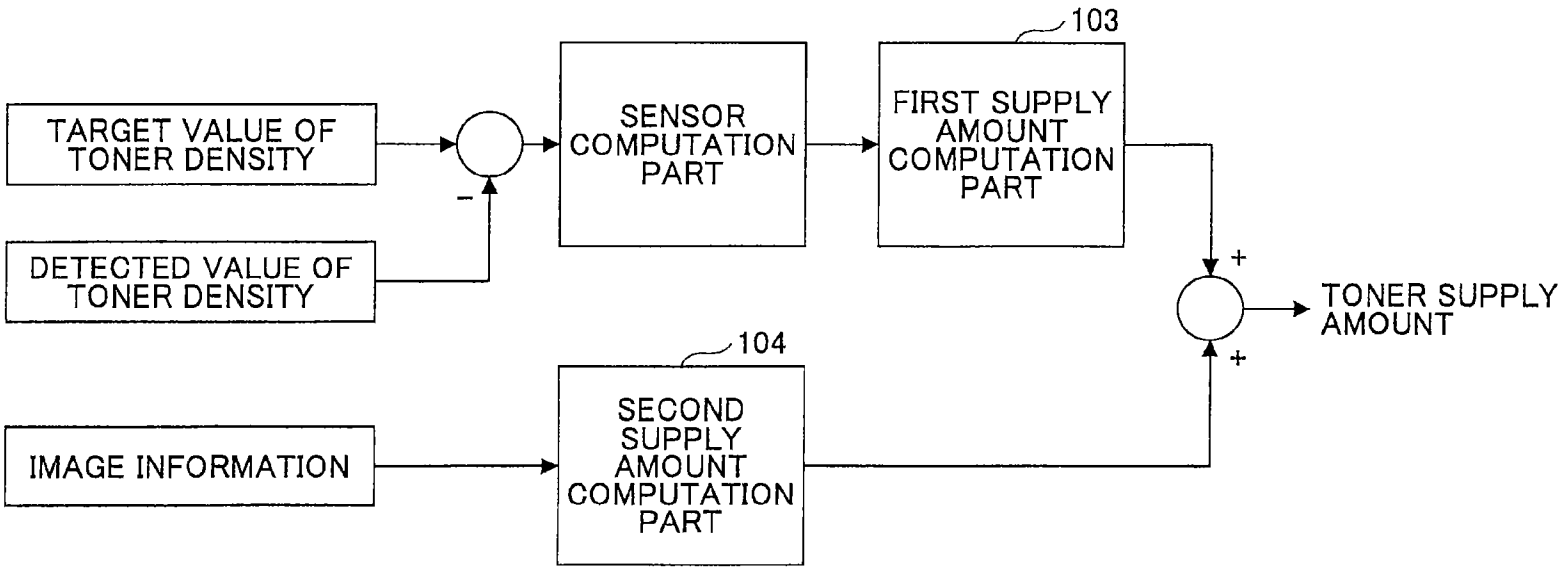
FIG. 10 is a block diagram illustrating a configuration of a feed-forward controller utilized in the controller illustrated in FIG. 9.
Figure 11:
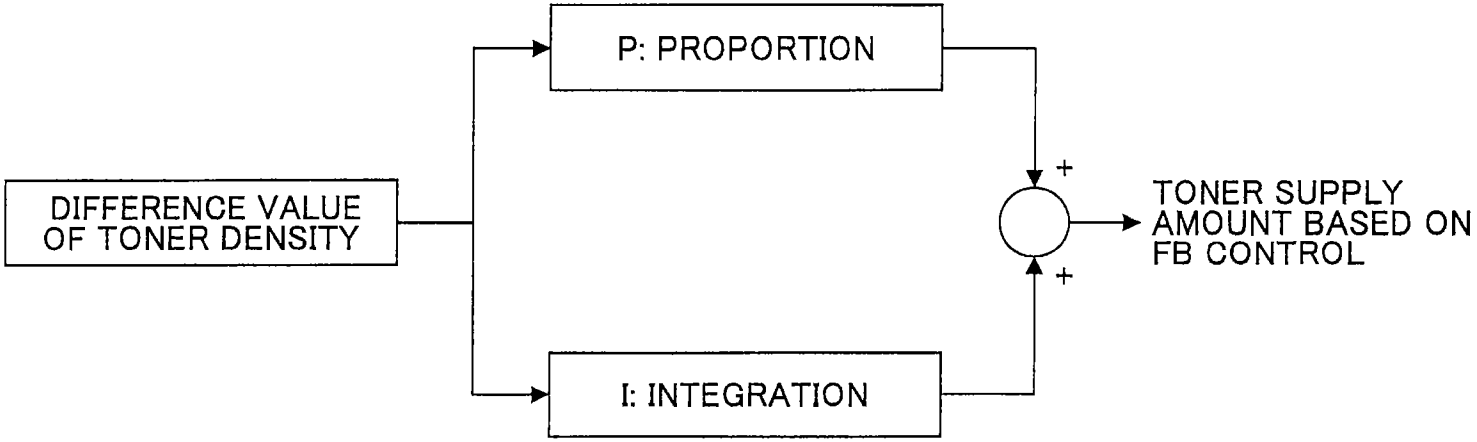
FIG. 11 is a block diagram illustrating a configuration of a feed-back controller utilized in the controller illustrated in FIG. 9.

The controller 100 includes a feed-forward control unit and a feed-back control unit illustrated in FIGS. 10 and 11. These control units are described as follows. FIG. 10 is a block diagram illustrating the feed-forward control unit. In FIG. 10, a target value of the toner density (hereinafter simply called a "target value") and a detected value of the toner density (hereinafter simply called a "detected value") obtained from the toner density sensor unit configured to detect a current value of the toner density are compared, and the comparison result is supplied to a sensor computation part. The comparison result is then supplied to a first supply computation part 103 so as to compute a necessary toner supply amount. Further, information associated with an output image such as image information or sheet information is supplied to a second supply computation part 104. The second supply computation part 104 is configured to compute a toner supply amount or toner supply timing based on toner consumption and consumption timing required by image information, so as to cancel out the toner consumption and consumption timing required by image information. A toner supply amount computed by the first supply computation part 103 and a toner supply amount computed by the second supply computation part 104 are combined such that a final toner supply amount is computed.

FIG. 11 is a diagram illustrating an example in which a PI control is utilized in the first supply computation part 103 illustrated in FIG. 10. As illustrated in FIG. 10, the difference between the target value of the toner density and the detected value of the toner density is computed by the sensor computation part and the computed difference is supplied to the first supply computation part 103. The computed difference is called a difference value of the toner density (hereinafter simply called a "difference value"). The greater the difference value, the more deviated from the target value of the toner density the current value (i.e., the detected value) may be. In this case, the difference value is divided and supplied to a proportion block P and an integration block I. In the proportion block P, the difference value is multiplied by gain, so that a value is output in proportion to a value of the difference.

On the other hand, in the integration block I, a difference value is accumulated every time the value is computed (i.e., per computing time). Thus, even if the value of the difference value is small, the value will increase as time progresses. This indicates that the value of the difference value will be securely followed. The value computed by the proportion block P and the value computed by the integration block I are added, and the addition value is then output as a toner supply amount based on a feedback (FB) control. In this embodiment, an example of utilizing the PI control is illustrated; however, any configuration having a function to store the difference value itself and accumulate the difference values may be used.

Figure 12:
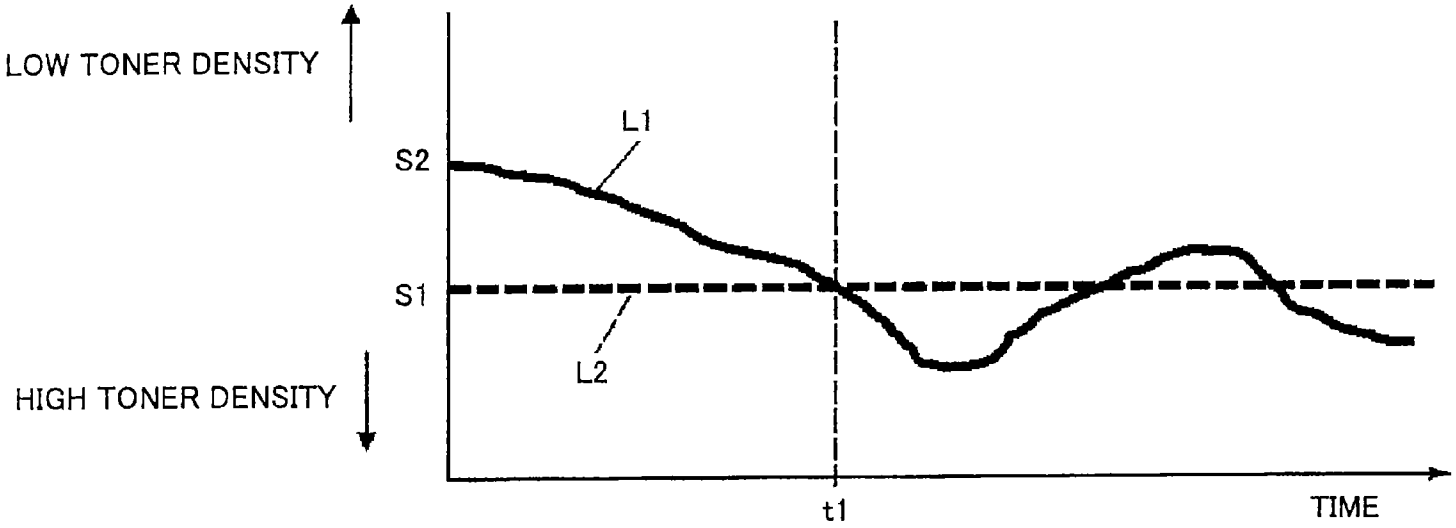
FIG. 12 is a line diagram illustrating an effect of related-art toner supply control.

Next, a control procedure executed in the controller 100 is described. First, description is given of features of the control (hereinafter also called a "toner supply control system" for convenience) executed in the developing device according to the embodiment. FIG. 12 is a diagram illustrating a general toner density control status. In FIG. 12, L1 indicates a detected value of the toner density (hereinafter simply called a "detected value") detected by a toner density sensor unit, and L2 indicates a target value of the toner density (hereinafter simply called a "target value").

In general, a toner supply operation may be designed by an engineer's intention in the toner supply control system; however, it is undesirable to design the toner supply operation since toner is a user's property. For example, reduction of toner consumption or reduction in toner density in the developing device may involve toner consumption unrelated to the user's intention. Therefore, as illustrated in FIG. 12, when a toner supply amount is adjusted or controlled based on a change in the toner density, toner density drift may occur, which may adversely affect the image quality.

For example, the toner density is managed as an initializing process at start-up of the device. In an initial status, a target value of the toner density (hereinafter simply called a "target value") is in a high toner density side S1, and a current value of the toner density (i.e., a detected value of the toner density, hereinafter simply called a "current value") is in a low toner density side S2. At this moment, in the toner supply control system, the current value (i.e., the detected value) in a low toner density side S2 gradually approaches the target value in a high toner density side S1 by receiving toner supplied based on a toner supply amount acquired from image information and toner supplied from a feedback (FB) control system to achieve optimal toner density. However, the change in the toner density will not stop, and the toner density becomes slightly high in a similar fashion as overrun indicating change in velocity at a time where the current value in a low toner density side S2 matches the target value in a high toner density side S1, that is, at a time where the toner density represented by the current value in a low toner density side S2 reaches the toner density represented by the target value in a high toner density side S1.

Thereafter, the FB control determines that the toner density is high, and subsequently adjusts a toner supply amount so that the toner density represented by the detected value in a low toner density side S2 approaches the toner density represented by the target value S1 in a high toner density side. However, similar to the above case, the change in the toner density will not stop at predetermined toner density and the toner density will continue to change excessively, which is illustrated by a line L1 in FIG. 12 representing repeated oscillation after the time t. The toner density fluctuation may result in image quality deterioration.

Thus, the following processes (1) to (5) are set.

Figure 13:
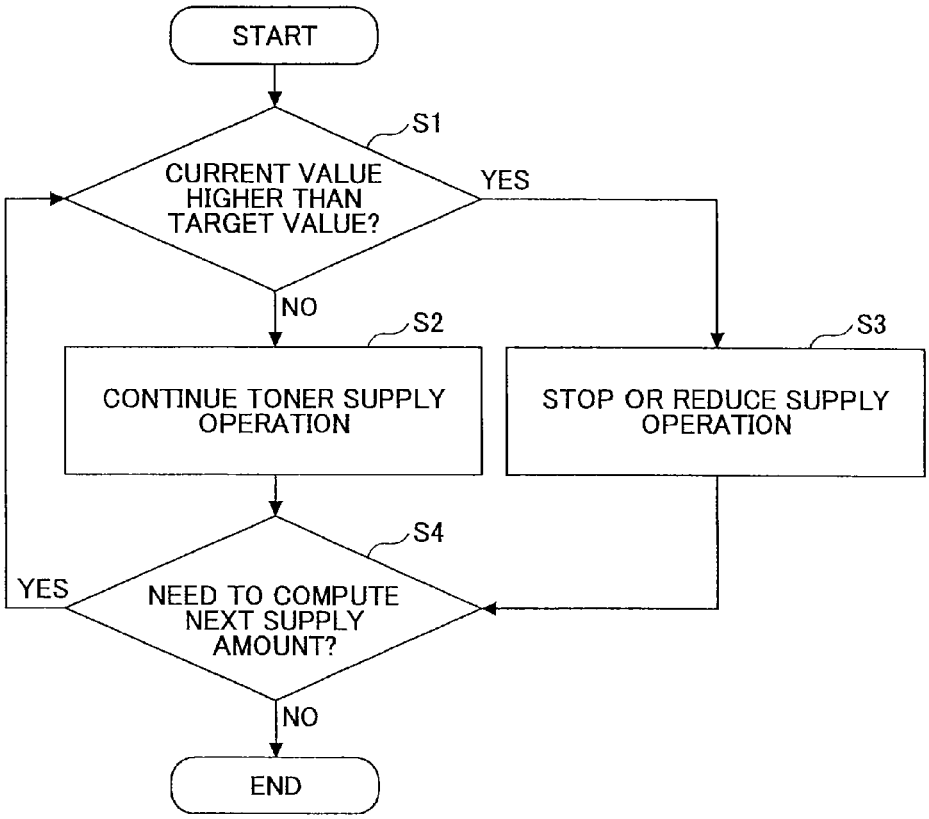
FIG. 13 is a flowchart illustrating a content of a first control executed in the developing device according to the embodiment.

(1) Toner supply itself is stopped, or the amount of toner to be supplied (a toner supply amount) is reduced. FIG. 13 is flowchart illustrating this process. In FIG. 13, when supply amount computation starts, whether a current value (i.e., a detected value) of the toner density (hereinafter simply called a "current value") is higher than a target value of the toner density (hereinafter simply called a "target value") is determined by comparison between the detected value (i.e., the current value) and the target value (step S1). When the current value is lower than the target value ("NO" in step S1), the toner supply operation is continued (step S2). However, when the current value is higher than the target value ("YES" in step S1), the toner supply operation is stopped or reduced (step S3). Subsequently, when a next supply amount computation needs to be computed (when the next supply amount computation exists) (step S4), the determination as to whether the current value is higher than the target value is carried out. On the other hand, when there is no next supply amount computation, the process is terminated.

Figure 14:
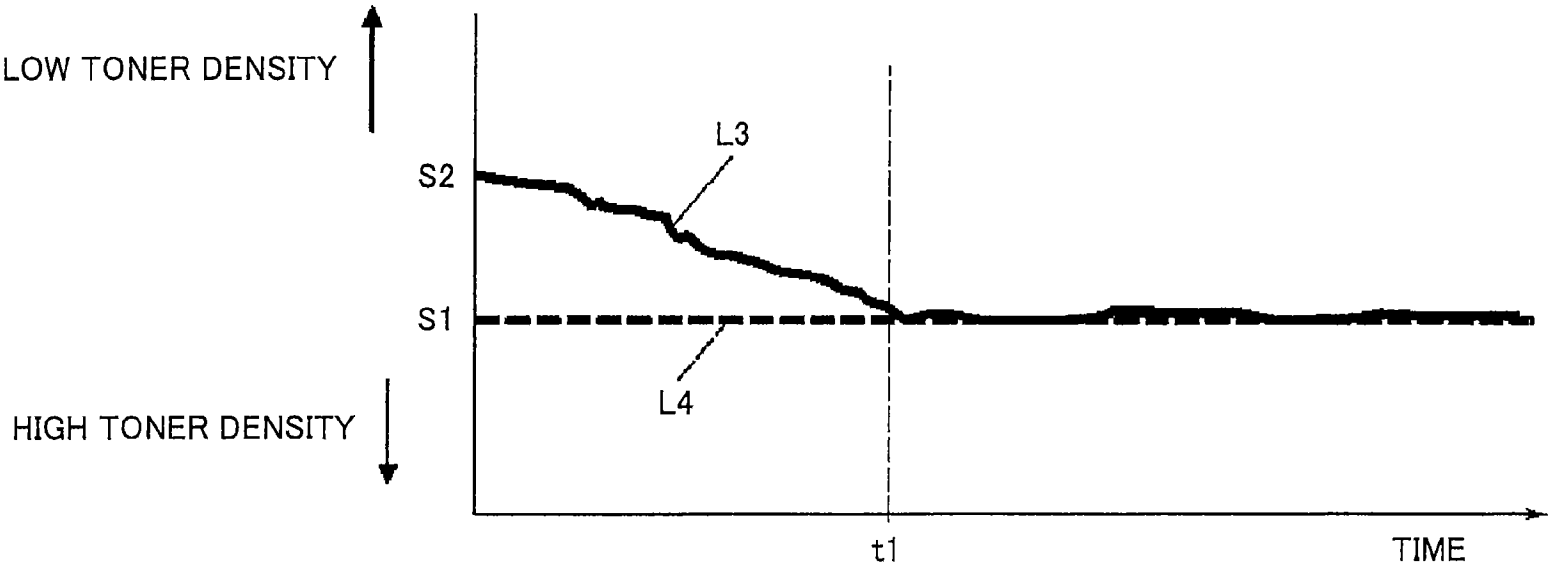
FIG. 14 is a line diagram illustrating an effect of a content of a second control executed in the developing device according to the embodiment.

FIG. 14 is a diagram illustrating a result of the toner density control system when the processes illustrated in FIG. 12 are employed. In FIG. 14, L3 indicates a detected value of the toner density (hereinafter simply called a "detected value") detected by the toner density sensor unit, and L4 indicates a target value of the toner density (hereinafter simply called a "target value"). In applying the flowchart illustrated in FIG. 13 to FIG. 14, when the detected value L3 becomes lower than the target value L4 corresponding to a high toner density side S1 after the detected value L3 reaches the target value L4 corresponding to the high toner density side S1 at time t1, toner supply operation itself is terminated. Thus, the toner density is in a consistent status where the toner density represented by the detected value L3 matches the target value L4 corresponding to the high toner density side S1 in FIG. 14.

Next, a process differing from the above-described process is described.

(2) Toner supply from the FB control unit is stopped, or reduced.

The fundamental problem is already described and thus, illustration of the fundamental problem is not repeated. Note that in the following, a case in which toner supply from the FB control unit is stopped is considered. It is preferable that the toner supply operation itself be stopped when the detected value becomes higher than the target value. However, whether the toner supply operation itself is stopped may be determined based on the output image, and in some cases, alternative processes may need to be considered. The above points are illustrated with reference to FIG. 15.

Figure 15:
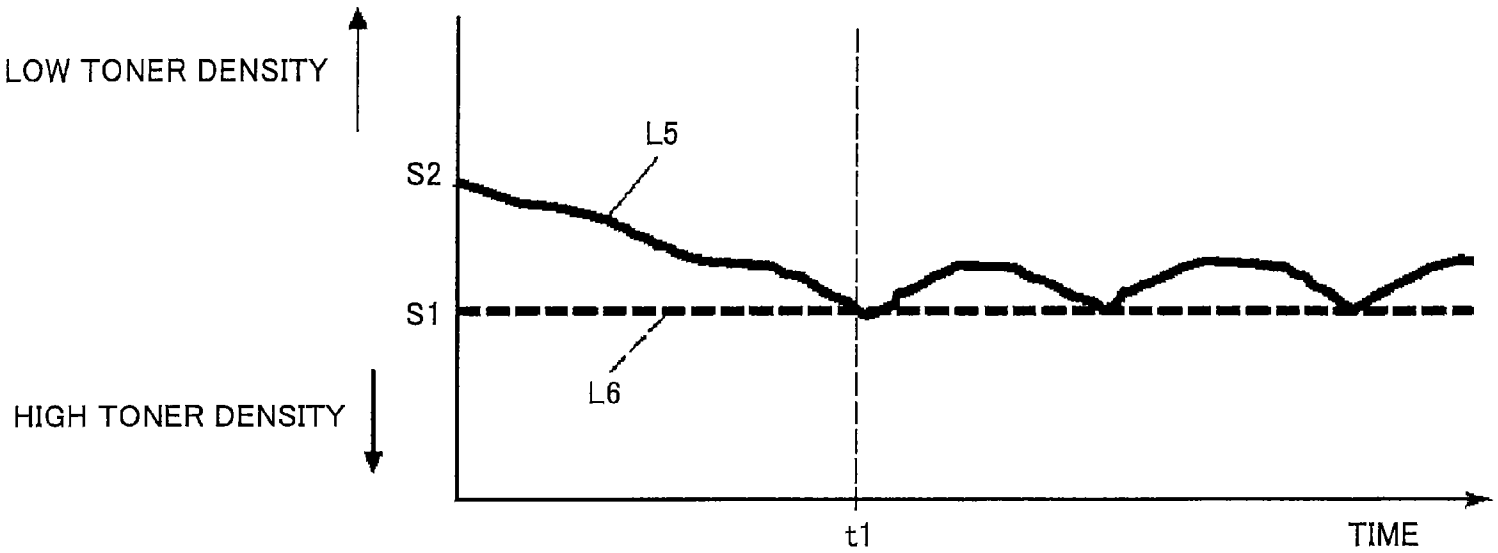
FIG. 15 is a line diagram illustrating an effect of a content of a third control executed in the developing device according to the embodiment.

In FIG. 15, when an image to be printed needs to consume a relatively large amount of toner such as a photographic image, and the toner supply operation itself is stopped or reduced, such an image is printed while the toner supply operation is stopped. As a result, the toner density of the image is reduced. Thereafter, when the toner supply operation is repeated such that the detected value of the toner density reaches the target value of the toner density, the toner supply operation is immediately stopped or reduced, thereby lowering the toner density again. Since the above operation is repeated, the fluctuation of the detected value of the toner density represented by L5 in FIG. 15 corresponding to the target value of the toner density represented by L6 exhibits oscillation behavior.

Figure 16:
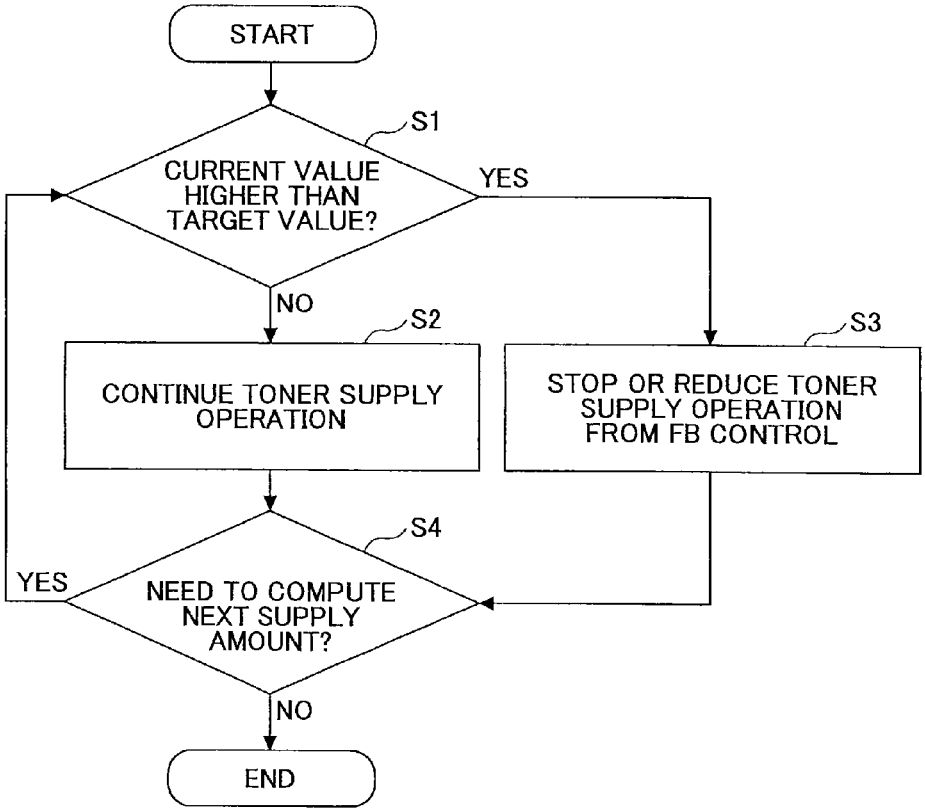
FIG. 16 is a flowchart illustrating the content of the third control illustrated in FIG. 15.

Hence, in this control process, the toner supply from the FB control unit is stopped or reduced as illustrated in FIG. 16. That is, in FIG. 16, when supply amount computation starts, whether a current value (i.e., a detected value) of the toner density (hereinafter simply called a "current value") is higher than a target value of the toner density (hereinafter simply called a "target value") is determined by comparison between the current value (i.e., detected value) and the target value (step S1). When the current value is lower than the target value ("NO" in step S1), the toner supply operation is continued (step S2). However, when the current value is higher than the target value ("YES" in step S1), the toner supply operation from the FB control is stopped or reduced (step S3).

Subsequently, when a next supply amount computation needs to be computed (when the next supply amount computation exists) (step S4), the determination as to whether the current value (i.e., the detected value) is higher than the target value is carried out again. On the other hand, when there is no next supply amount computation, the process is terminated.

The purpose of stopping or reducing the toner supply operation from the FB control alone is as follows. Since the toner supply amount obtained by computing the amount of toner consumed by forming an image is the toner amount that will be actually consumed, the value computed based on the amount of toner consumed by forming the image is an important computational value for suppressing the toner density fluctuation. A requirement followed by the target value of the toner density is obtained by achieving entire process equilibrium such as the adjustment of the development bias. Thus, excessive supply may be prevented by terminating the toner supply from the FB control. Further, even when the image required for consuming a large amount of toner such as a solid image is output, the detected value of the toner density may be able to follow the target value of the toner density.

Figure 17:
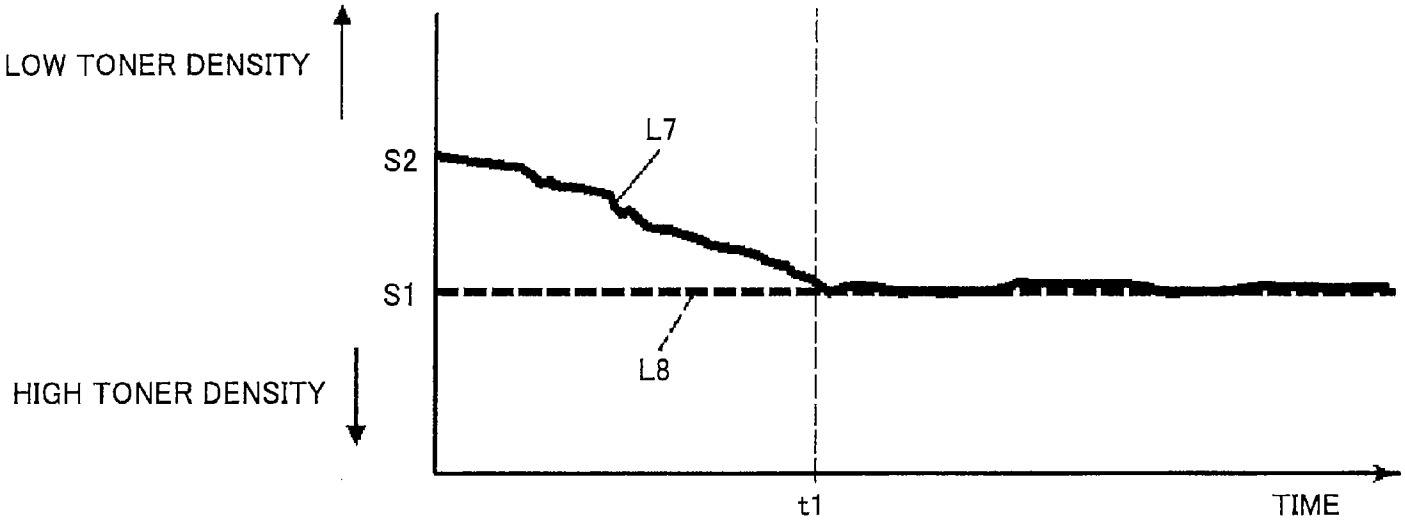
FIG. 17 is a line diagram illustrating an effect of a content of a fourth control executed in the developing device according to the embodiment.

FIG. 17 is a diagram illustrating toner density fluctuation based on the above-described process. In FIG. 17, L7 indicates a detected value of the toner density (hereinafter simply called a "detected value") detected by the toner density sensor unit, and L8 indicates a target value of the toner density (herein after simply called a "target value"). In applying the flowchart illustrated in FIG. 16 to FIG. 17, the detected value does not become higher than the target value corresponding to the high toner density side S1 after the detected value reaches the target value corresponding to the high toner density side S1 at time t1. Thus, the detected value is in a consistent status where the detected matches the target value represented by L7 in FIG. 17.

(3) Toner supply from a feedforward (FF) control unit is stopped, or reduced.

Figure 18:
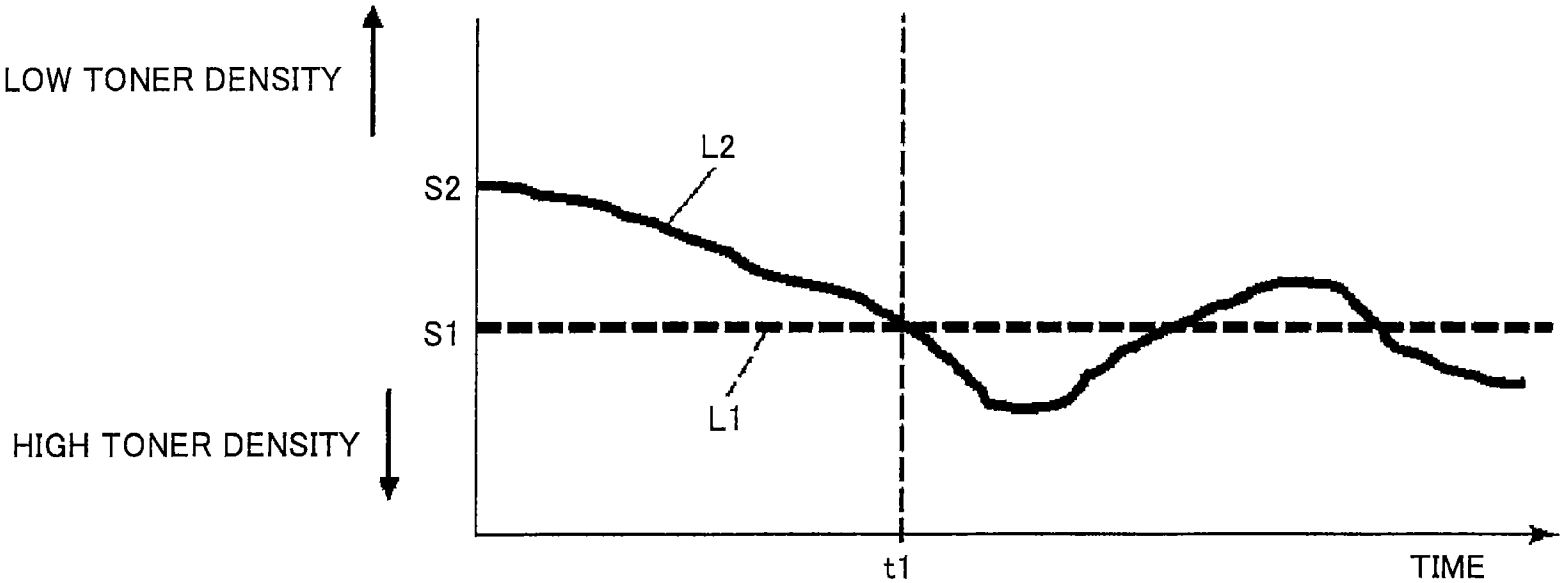
FIG. 18 is a line diagram illustrating an effect of a content of a fifth control executed in the developing device according to the embodiment.

The fundamental problem is already described and thus, illustration of the fundamental problem is not repeated. The problem in this process is the same as that illustrated in FIG. 12. In FIG. 18, L1 indicates a target value of the toner density (hereinafter simply called a "target value"), and L2 indicates a current value (i.e., a detected value) of the toner density (hereinafter simply called a "current value") detected by the toner density sensor unit. In an initial status, the target value is in a high toner density side S1, and the current value is in a low toner density side S2 immediately after the apparatus main body starts; that is, when some kind of adjustment is applied. At this moment, in the toner supply control system, the current value (i.e., the detected value) gradually approaches the target value in the high toner density side S1 by receiving toner supplied based on a toner supply amount acquired corresponding to image information, and toner supplied from a feedback (FB) control system to achieve optimal toner density. However, the change in the toner density will not stop and the toner density becomes slightly high at a time that the toner density matches the target toner density in the high toner density side S1, that is, at a time that the current value reaches the target toner value in the high toner density side S1. Thereafter, the FB control determines that the toner density is high, and subsequently adjusts a toner supply amount. Accordingly, the current value approaches the target value in the high toner density side S1. However, the change in the toner density will not stop at a time where the current value matches the target value in the high toner density side S1 and the current value will continue to change excessively, which is illustrated by a line L2 in FIG. 18 representing toner density drift due to repeated oscillation after the time t1. The toner density fluctuation may result in image quality deterioration.

By contrast, when the toner supply amount is determined as excessive, it may be possible for the toner density to follow the target value of the toner density by terminating the supply operation as illustrated in FIG. 14.

However, various computations has been carried out by the FB control configured to compute a property following the target value of the toner density. For example, there may be an item serving as a function to accumulate previous deviations and integrate the accumulated deviations. By contrast, as illustrated in the above (1) and (2), when the supply amount computation from the FB control is stopped, there may be an error in computing the accumulated value.

Further, when an image required for consuming a large amount of toner such as a solid image is printed, it may be insufficient to only stop or reduce the toner supply from the FB control illustrated in (2) in some condition.

Figure 19:
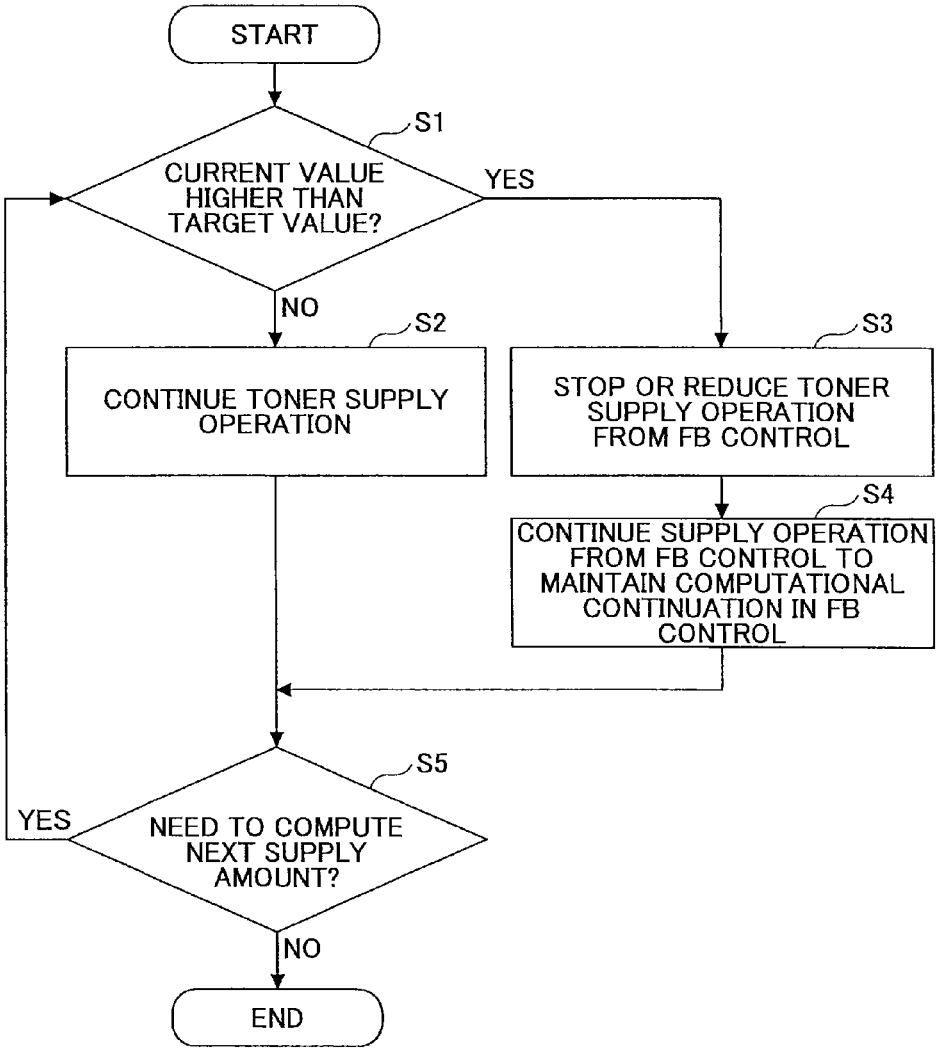
FIG. 19 is a flowchart illustrating the content of the fifth control illustrated in FIG. 18.

Thus, the supply operation illustrated in FIG. 19 may be executed in order to avoid excessive supply or the oscillating status against a value of the toner density. The flowchart of FIG. 19 is briefly described below. First, when the supply amount computation starts, whether a current value (i.e., a detected value) of the toner density (hereinafter simply called a "current value") is higher than a target value of the toner density (hereinafter simply called a "target value") is determined by comparing the current value (i.e., the detected value) and the target value (step S1). When the current value is lower than the target value ("NO" in step S1), the supply operation will be continued.

However, when the current value (i.e., the detected value) is higher than the target value ("YES" in step S1), the supply operation from the feedforward (FF) control is stopped or reduced (step S3). Note that the supply operation from the FB control is continued as it is to maintain computational continuation in the FB control (step S4). Thereafter, when a next supply computation needs to be performed (i.e., when there is next supply computation) ("YES" in step S5), the determination as to whether the current value (i.e., the detected value) is higher than the target value is carried out again. On the other hand, when there is no next supply amount computation ("NO" in step S5), the process is terminated.

The supply operation only from the FF control is stopped since the main factor of the toner density fluctuation is an image output. As illustrated in FIG. 18, the toner density oscillates because the equilibrium of the amount of toner consumed for printing (outputting) an image and the amount of toner supplied (i.e., toner supply amount) is not maintained.

Figure 20:
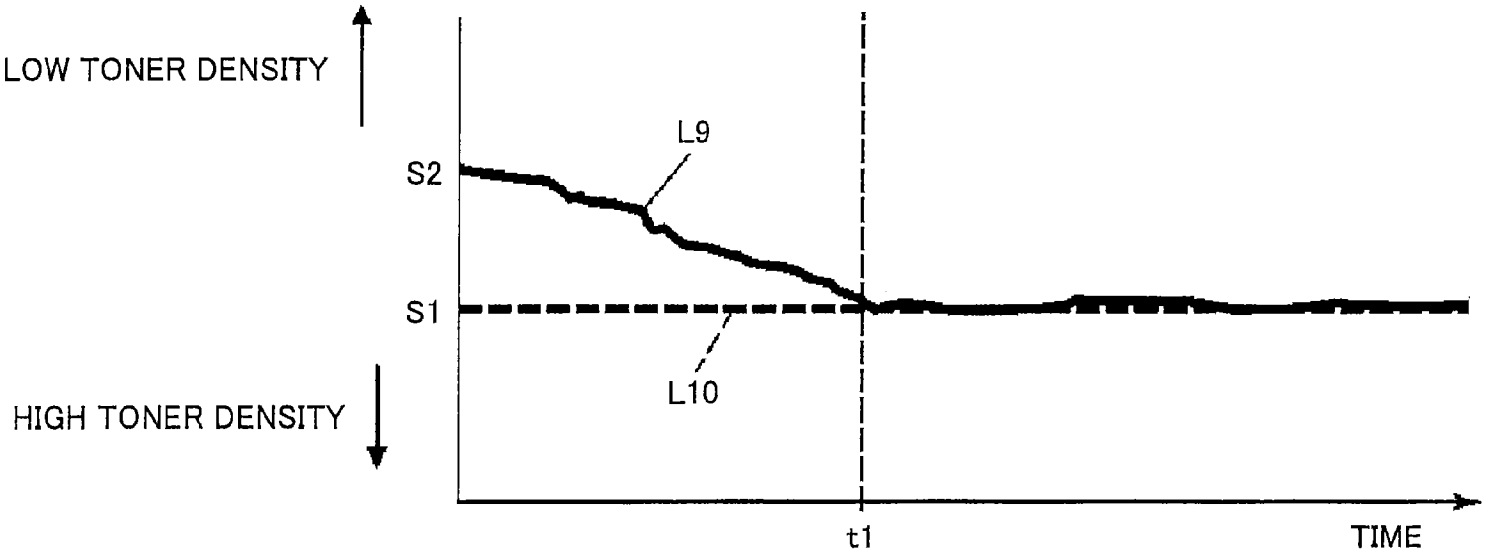
FIG. 20 is a line diagram illustrating an effect of a content of a sixth control executed in the developing device according to the embodiment.

The FF control computes the toner supply amount to maintain the above equilibrium. It is possible to prevent the detected value of the toner density from excessively increasing by utilizing a large amount of correction performed by the FF control and to allow the detected value of the toner density to follow the target value of the toner density by leaving the capacity of the FB control to securely and gradually follow the target value of the toner density intended by an engineer as illustrated in FIG. 20. Note that in FIG. 20, L9 indicates a detected value of the toner density (hereinafter simply called a "detected value") detected by the toner density sensor unit, and L10 indicates a target value of the toner density (hereinafter simply called a "target value").

(4) The unnecessary supply from the FB control unit is eliminated from the supply from the FF control unit.

The fundamental problem is already described and thus, illustration of the fundamental problem is not repeated. The problem in this process is the same as that illustrated in FIGS. 12 and 18.

The detected value will not become higher than the target value by stopping the supply operation. However, stopping or reducing the supply operation unexpectedly for certain timings may cause a drastic change in the status, which may adversely affect image quality. Thus, it is preferable to avoid simply stopping or reducing the supply operation.

Thus, in this control process, the supply operation is not simply stopped or reduced. Instead, when the detected value is higher than the target value, the supply operation is reduced by computing the supply amount. This method is illustrated in FIG. 21 as a supply operation correcting process.

Figure 21:
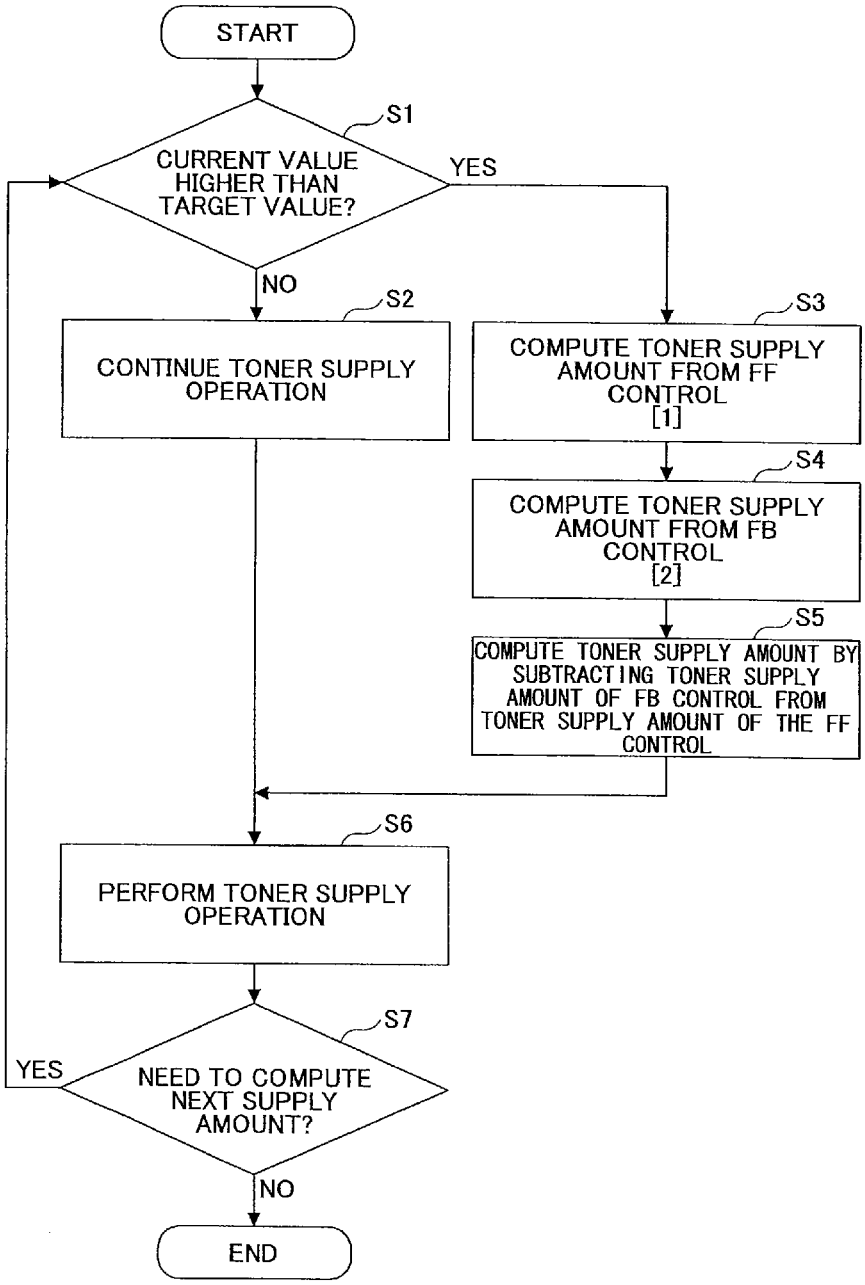
FIG. 21 is a flowchart illustrating the content of the sixth control illustrated in FIG. 20.

In the flowchart of FIG. 21, when supply amount computation starts, whether a current value (i.e., the detected value) of the toner density (hereinafter simply called a "current value") is higher than a target value of the toner density (hereinafter simply called a "target value") is determined by comparison between the current value and the target value (step S1). When the current value is lower than the target value ("NO" in step S1), the supply operation will be continued (step S2). However, when the current value (i.e., the detected value) is higher than the target value ("YES" in step S1), the toner supply amount from the FF control is computed first (step S3). Thereafter, or simultaneously, the toner supply amount from the FB control is computed (step S4). Then, the toner supply amount from the FB control is subtracted from the toner supply amount from the FF control (step S5). That is, the toner supply operation is reduced by computing the supply amount, which is obtained by subtracting the supply amount of the FB control from the supply amount of the FF control. The toner supply operation is then performed (step S6). Then, when a next supply computation needs to be performed (i.e., when there is a next supply computation) ("YES" in step S7), the determination as to whether the current value (i.e., the detected value) is higher than the target value is carried out again. On the other hand, when there is no next supply amount computation ("NO" in step S7), the process is terminated.

Figure 22:
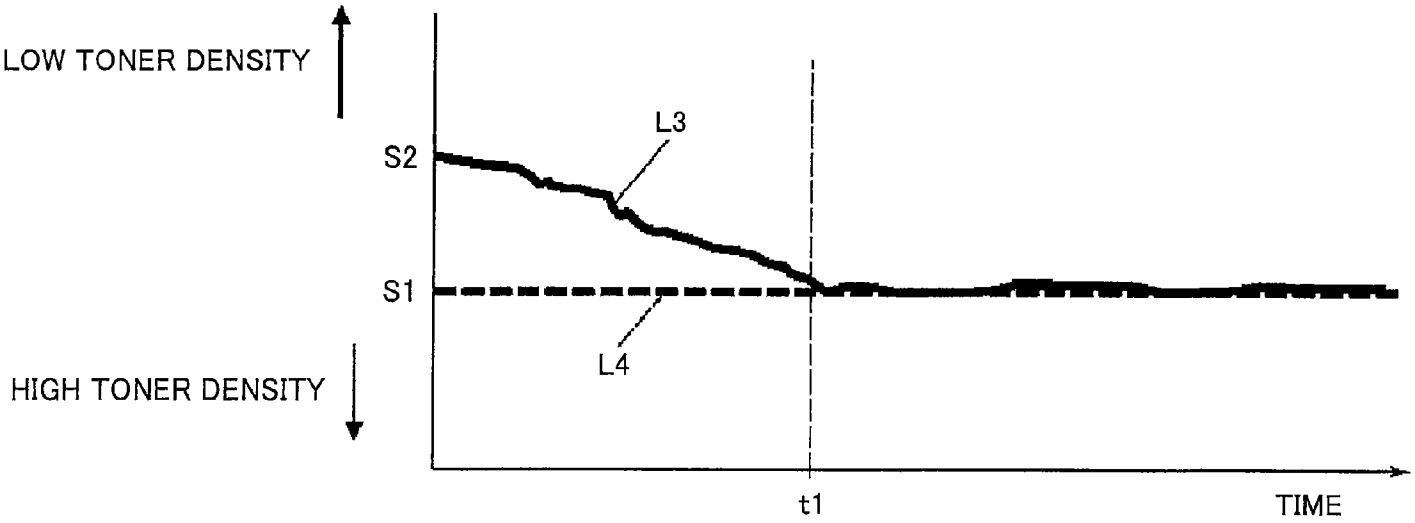
FIG. 22 is a line diagram illustrating an effect of a content of a seventh control executed in the developing device according to the embodiment.

FIG. 22 illustrates toner density fluctuation based on the flowchart illustrated in FIG. 21. In FIG. 22, L11 indicates a detected value of the toner density (hereinafter simply called a "detected value") detected by the toner density sensor unit, and L12 indicates a target value of the toner density (hereinafter simply called a "target value"). In the initial stage, the detected value is in a low toner density side S2, and the target value is in a high toner density side S1 indicating the target value of the toner density being higher than the detected value of the toner density in a low toner density side S2. The supply operation is performed without any specific correcting operation since the toner density needs to be increased until time t1.

The detected value reaches the target value at a time reaching time t1. Subsequently, the corrected supply operation is performed by subtracting the supply amount computed by the FB control from the supply amount computed by the FF control based on formation of an image. When no correction is applied, the supply amount based on the image and the supply amount from the FF control will be continued. In such a case, even when a value computed by the FB control indicates reduction in the supply amount, it may be unable to actually perform the negative supply. Thus, the condition of having deviations from the target value of the toner density may be continued.

On the other hand, according to the system indicated by the flowchart of FIG. 21, the supply amount computed by the FB control is continuously subtracted from the supply amount computed by the FF control. Thus, the current value (i.e., the detected value) may be able to eventually follow the target value of the toner density.

(5) A value of an integral term is cleared by the FB control unit, and a value of the integral term is reduced by the FB control unit by utilizing a previous value of the integral term.

The fundamental problem is already described and thus, illustration of the fundamental problem is not repeated. The problem in this process is the same as that illustrated in FIG. 4. The detected value of the toner density will not be higher than the target value of the toner density by stopping or reducing the supply operation. However, stopping or reducing the supply operation unexpectedly for certain timing may cause a drastic change in the status, which may adversely affect image quality. Thus, it is preferable to avoid simply stopping or reducing the supply operation. At this moment, a factor that may cause an excessive supply is considered below. Since the FF control is configured to compute the supply amount based on the output image information, it is fundamentally not a problem to continue the supply operation.

On the other hand, the FB control is configured to compute the supply amount based on the difference between the current value of the toner density and the target value of the toner density. In this computation, an integral term is generally provided for facilitating the property to follow the target value. However, the integral term accumulating previous deviations may exhibit the largest supply amount when the toner density is near the target value of the toner density.

Figure 23:
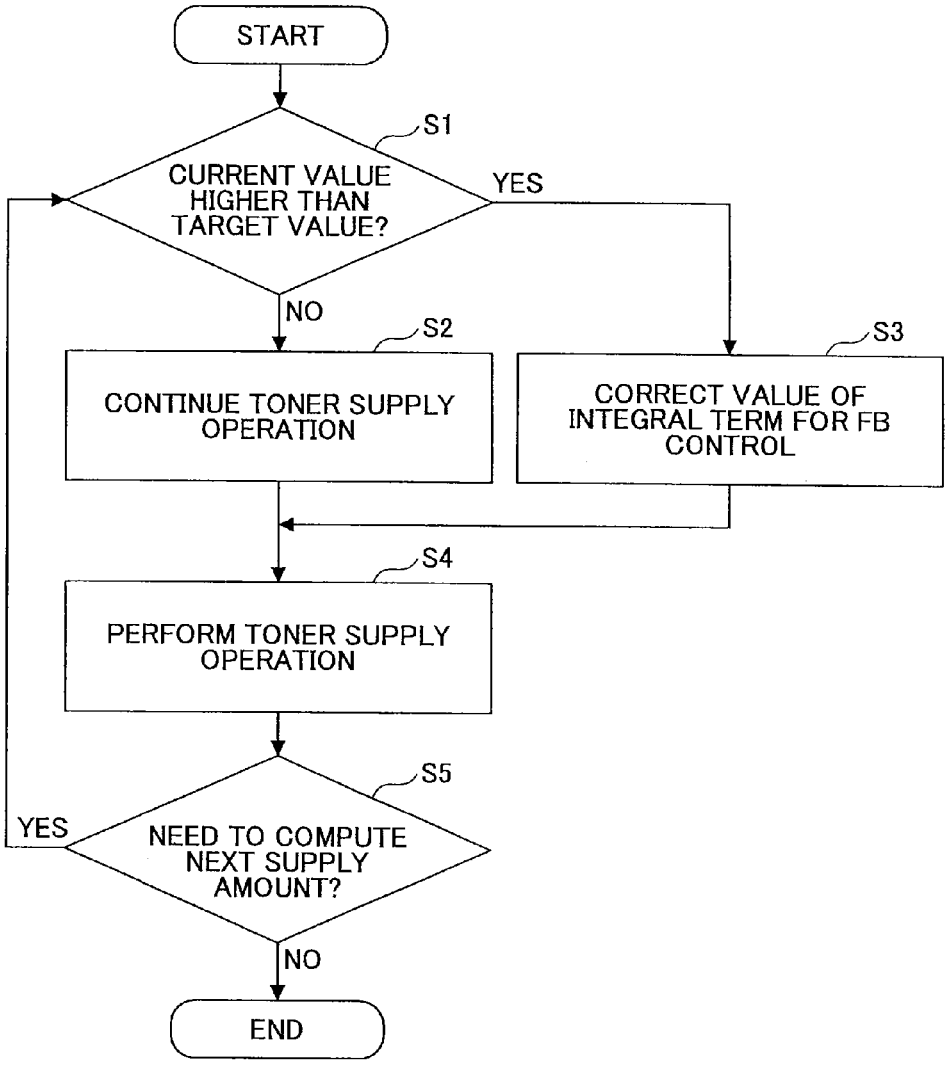
FIG. 23 is a flowchart illustrating the content of the seventh control illustrated in FIG. 22.

FIG. 23 illustrates a supply operation correcting process to cause the toner density to follow the target value of the toner density while avoiding a drastic change by correcting the value of the integral term. In the flowchart of FIG. 23, when supply amount computation starts, whether a current value (i.e., a detected value) of the toner density (hereinafter simply called a "current value") is higher than a target value of the toner density is determined by comparison between the current value (i.e., the detected value) and the target value (step S1). When the current value is lower than the target value ("NO" in step S1), the supply operation will be continued (step S2). However, when the current value is higher than the target value ("YES" in step S1), the value of the integral term is corrected for computing the supply amount from the FB control (step S3). The correction may be performed by clearing the accumulated value itself, or by gradually reducing the accumulated current value utilizing previous accumulated value.

When the accumulated value itself is cleared, the adverse effect of the integral term may be immediately reduced. However, the computational continuation may be reduced by clearing the accumulated value. On the other hand, the correction such as reducing the accumulated current value utilizing the previous accumulated value may maintain the computational continuation. Accordingly, an unexpected change is unlikely to occur for overall calculation. In this example, a method of clearing accumulated value or a method of reducing the previous accumulated value is described as the supply operation correcting process; however, other methods may also be used. The toner supply operation is then performed, thereafter. Then, when a next supply computation needs to be performed (i.e., when there is no next supply computation), the determination as to whether the current value (i.e., the detected value) is higher than the target value is carried out again. On the other hand, when there is no next supply amount computation, the process is terminated.

As described above, when the current value (i.e., the detected value) is higher than the target value, the supply operation may simply be stopped or reduced so as to prevent the toner density fluctuation from exhibiting drifting, rather than adjusting the toner supply amount from following the toner density fluctuation. Accordingly, it may be possible to prevent the density of the image from being adversely affected by the development of the image.

According to the embodiment, when the target value of the toner density is more deviated toward a high toner density side than the detected value of the toner density, the toner supply operation is stopped or reduced, thereby preventing the toner density from being increased. Accordingly, the toner density will not be increased, which may facilitate matching of the detected value of the toner density and the target value of the toner density.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2012-023705 filed on Feb. 7, 2012, the entire contents of which are hereby incorporated herein by reference.

What is claimed is:

1. An image forming apparatus comprising:

an electrostatic latent image carrier configured to carry an electrostatic latent image;

a developing device configured to visualize the electrostatic latent image utilizing a two-component developer;

a supply device configured to supply toner according to a change in toner density of toner contained in the two-component developer inside the developing device; and a control device having an input side connected to a density sensor configured to detect a value of the toner density and an image information acquisition device configured to acquire information on an image formed on the electrostatic latent image carrier, and an output side connected to a driving device configured to drive the supply device, wherein the control device is configured to store a target value of the toner density, the control device including a feedforward control unit configured to determine a first toner supply amount matching the target value based on an input from the image information acquisition device, and a feedback control unit configured to determine a second toner supply amount based on a difference between the detected value of the toner density obtained by the density sensor and the target value and based on an aggregation of the difference over a plurality of times that the difference is determined, and the feedback control unit divides a difference value between the detected value and the target value into an integration block and a proportion block, and determines the second toner supply amount by adding respective computational values of the integration block and the proportion block, and wherein when the control device obtains a comparison result indicating that the detected value is higher than the target value, the control device performs control to stop the driving device, or performs control to drive the driving device to supply toner in an amount less than a combined toner supply amount obtained by adding the first toner supply amount and the second toner supply amount.

2. The image forming apparatus as claimed in claim 1, wherein when the control device obtains a comparison result indicating that the detected value is higher than the target value, the control device performs control to exclude the second toner supply amount or utilize a toner amount less than the second toner supply amount in computing the combined toner supply amount.

3. The image forming apparatus as claimed in claim 1, wherein when the control device obtains a comparison result indicating that the detected value is higher than the target value, the control device performs control to exclude the first toner supply amount or utilize a toner amount less than the first toner supply amount in computing the combined toner supply amount.

4. The image forming apparatus as claimed in claim 1, wherein when the control device obtains a comparison result indicating that the detected value is higher than the target value, the control device performs control to utilize a toner amount obtained by subtracting the second toner supply amount from the first toner supply amount as the combined toner supply amount.

5. The image forming apparatus as claimed in claim 1, wherein when the control device obtains a comparison result indicating that the detected value is higher than the target value, the control device performs control to exclude the computational value of the proportion block or utilize a toner amount less than the computational value of the proportion block in computing the second supply amount in the feedback control unit.

6. The image forming apparatus as claimed in claim 1, wherein when the control device obtains a comparison result indicating that the detected value is higher than the target value, the control device performs control to exclude the computational value of the integration block or utilize a toner amount less than the computational value of the integration block in computing the second supply amount in the feedback control unit.

7. The image forming apparatus as claimed in claim 6, wherein the computational value of the integration block is corrected utilizing a previous accumulated value.

8. A method for controlling toner supply in an image forming apparatus, the image forming apparatus including an electrostatic latent image carrier configured to carry an electrostatic latent image, a developing device configured to visualize the electrostatic latent image utilizing a two-component developer, a supply device configured to supply toner according to a change in toner density of toner contained in the two-component developer inside the developing device, and a control device having an input side connected to a density sensor configured to detect a value of the toner density and an image information acquisition device configured to acquire information on an image formed on the electrostatic latent image carrier, and an output side connected to a driving device configured to drive the supply device, the method comprising:

storing a target value of the toner density;

determining a first toner supply amount matching the target value based on an input from the image information acquisition device;

determining a second toner supply amount based on a difference between a detected value of the toner density obtained by the density sensor and the target value and based on an aggregation of the difference over a plurality of times that the difference is determined, and a difference value between the detected value and the target value is divided into an integration block and a proportion block, and the second toner supply amount is determined by adding respective computational values of the integration block and the proportion block;

comparing the detected value and the target value; and controlling to stop the driving device, or controlling to drive the driving device to supply toner in an amount less than a combined toner supply amount obtained by adding the first toner supply amount and the second toner supply amount when the control device obtains a comparison result indicating that the detected value is higher than the target value.

9. The method as claimed in claim 8, further comprising:

controlling to exclude the second toner supply amount or utilize a toner amount less than the second toner supply amount in computing the combined toner supply amount when the comparison result indicates that the detected value is higher than the target value.

10. The method as claimed in claim 8, further comprising:

controlling to exclude the first toner supply amount or utilize a toner amount less than the first toner supply amount in computing the combined toner supply amount when the comparison result indicates that the detected value is higher than the target value.

11. The method as claimed in claim 8, further comprising:

controlling to utilize a toner amount obtained by subtracting the second toner supply amount from the first toner supply amount as the combined toner supply amount when the comparison result indicates that the detected value is higher than the target value.

12. The method as claimed in claim 8, further comprising:

controlling to exclude the computational value of the proportion block or utilize a toner amount less than the computational value of the proportion block in computing the second supply amount in the determining of the second toner supply amount when the comparison result indicates that the detected value is higher than the target value.

13. The method as claimed in claim 8, further comprising:

controlling to exclude the computational value of the integration block or utilize a toner amount less than the computational value of the integration block in computing the second supply amount in the determining of the second toner supply amount when the comparison result indicates that the detected value is higher than the target value.

14. The method as claimed in claim 13, wherein the computational value of the integration block is corrected utilizing a previous accumulated value.

15. An image forming apparatus comprising:

an electrostatic latent image carrier configured to carry an electrostatic latent image;

a developing device configured to visualize the electrostatic latent image utilizing a two-component developer;

a supply device configured to supply toner according to a change in toner density of toner contained in the two-component developer inside the developing device; and a control device having an input side connected to a density sensor configured to detect a value of the toner density and an image information acquisition device configured to acquire information on an image formed on the electrostatic latent image carrier, and an output side connected to a driving device configured to drive the supply device, wherein the control device is configured to store a target value of the toner density, the control device including a feedforward control unit configured to determine a first toner supply amount matching the target value based on an input from the image information acquisition device, and a feedback control unit configured to determine a second toner supply amount based on a difference between the detected value of the toner density obtained by the density sensor and the target value, and the feedback control unit divides a difference value between the detected value and the target value into an integration block and a proportion block, and determines the second toner supply amount by adding respective computational values of the integration block and the proportion block, and wherein when the control device obtains a comparison result indicating that the detected value is higher than the target value, the control device performs control to stop the driving device, or performs control to drive the driving device to supply toner in an amount less than a combined toner supply amount obtained by adding the first toner supply amount and the second toner supply amount.

* * * * *